US010224649B2

(12) United States Patent
Urano

(10) Patent No.: US 10,224,649 B2
(45) Date of Patent: Mar. 5, 2019

(54) CABLE CONNECTOR WITH PLATE-LIKE MOUNTING PORTION

(71) Applicant: JAPAN AVIATION ELECTRONICS INDUSTRY, LIMITED, Tokyo (JP)

(72) Inventor: Tetsu Urano, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 3 days.

(21) Appl. No.: 15/480,657

(22) Filed: Apr. 6, 2017

(65) Prior Publication Data

US 2018/0026382 A1 Jan. 25, 2018

(30) Foreign Application Priority Data

Jul. 21, 2016 (JP) ..... 2016-143090

(51) Int. Cl.

| | |
|---|---|
| ***H01R 4/48*** | (2006.01) |
| ***F21V 23/06*** | (2006.01) |
| ***H01R 12/53*** | (2011.01) |
| *F21Y 115/10* | (2016.01) |
| *H01R 12/57* | (2011.01) |
| *H01R 12/58* | (2011.01) |
| *H01R 43/16* | (2006.01) |

(52) U.S. Cl.

CPC ..... *H01R 4/4818* (2013.01); *F21V 23/06* (2013.01); *H01R 12/53* (2013.01); *F21Y 2115/10* (2016.08); *H01R 12/57* (2013.01); *H01R 12/58* (2013.01); *H01R 43/16* (2013.01)

(58) Field of Classification Search

CPC ..... H01R 4/4818; H01R 12/88

USPC ..... 439/78

See application file for complete search history.

(56) References Cited

U.S. PATENT DOCUMENTS

| | | | | |
|---|---|---|---|---|
| 4,299,436 | A * | 11/1981 | Ackerman | H01R 12/55 439/853 |
| 7,357,651 | B2 * | 4/2008 | Minoura | H01R 13/111 439/82 |
| 7,448,901 | B2 * | 11/2008 | Weber | H01R 4/4818 439/427 |
| 7,513,793 | B2 * | 4/2009 | Horst | H01R 4/4818 439/427 |
| 8,550,837 | B2 * | 10/2013 | Tagawa | H01R 12/7023 439/345 |

(Continued)

FOREIGN PATENT DOCUMENTS

| | | | |
|---|---|---|---|
| CN | 101563813 | A | 10/2009 |
| JP | 2010-514138 | A | 4/2010 |

(Continued)

*Primary Examiner* — Tulsidas C Patel
*Assistant Examiner* — Peter G Leigh
(74) *Attorney, Agent, or Firm* — Collard & Roe, P.C.

(57) ABSTRACT

A connector has a mounting portion of a plate-like shape and a cable fitting portion protruding from the mounting portion in a first direction. The mounting portion has a fixing portion disposed on a first flat surface faced to the first direction and adapted to be fixed to a board, and a flat portion disposed on a second flat surface faced to a second direction opposite to the first direction. The cable fitting portion has a receiving portion adapted to receive a cable, an opening portion formed at one end of the receiving portion and allowing the cable to be inserted therethrough, and a cable contact portion to be electrically connected to the cable.

14 Claims, 25 Drawing Sheets

(56) References Cited

U.S. PATENT DOCUMENTS 8,636,523 B2 * 1/2014 Nagasaki ..... H01R 4/2404 439/439
8,764,459 B2 * 7/2014 Decker ..... H01R 4/4818 439/83
8,851,903 B2 * 10/2014 Decker ..... H01R 12/73 439/65
8,968,022 B2 * 3/2015 Mostoller ..... H01R 4/4836 439/438
9,130,323 B2 * 9/2015 Kim ..... H01R 12/88
9,306,297 B2 * 4/2016 Bishop ..... H01R 4/4818
9,306,301 B2 * 4/2016 Shimoji ..... H01R 12/53
9,825,382 B2 * 11/2017 Xiao ..... H01R 12/707
2006/0228947 A1 * 10/2006 Landis ..... H01R 4/4818 439/607.41
2008/0153327 A1 * 6/2008 Weber ..... H01R 4/4818 439/83
2008/0153344 A1 * 6/2008 Horst ..... H01R 4/4818 439/427
2012/0225575 A1 * 9/2012 Tagawa ..... H01R 12/7023 439/345
2012/0264326 A1 10/2012 Kudo et al.
2014/0024230 A1 * 1/2014 Decker ..... H01R 12/73 439/65
2014/0242833 A1 8/2014 Mostoller et al.
2014/0363990 A1 * 12/2014 Kim ..... H01R 12/79 439/67
2016/0049745 A1 * 2/2016 Jin ..... H01R 4/4836 439/733.1
2016/0087359 A1 * 3/2016 Fu ..... H01R 4/4818 439/884
2016/0099528 A1 * 4/2016 Lin ..... H01R 4/4836 439/638

FOREIGN PATENT DOCUMENTS

TW 201136037 A 10/2011
TW I477002 B 3/2015
WO 2008/082533 A2 7/2008

* cited by examiner

CABLE CONNECTOR WITH PLATE-LIKE MOUNTING PORTION

This application is based upon and claims the benefit of priority from Japanese Patent Application No. 2016-143090 filed on Jul. 21, 2016, the disclosure of which is incorporated herein in its entirety by reference.

TECHNICAL FIELD

This invention relates to a connector and, in particular, to a connector adapted to be mounted to a board and to receive a cable. In this application, the cable means a linear conductor and includes, in particular, a coated conductor.

BACKGROUND ART

As a connector of the type, proposal is made of a surface-mount connector described in JP-A-2010-514138 (hereinafter referred to as Patent Document 1). As shown in FIG. 24, the surface-mount connector described in Patent Document 1 is configured as, for example, a low-profile surface-mount electrical connector (SMEC) 720 which is disposed on one surface of a board 730 together with a light emitting diode (LED) 750 and a resistor 740. In FIG. 24, directions perpendicular to the board 730 and going up and down in the figure are referred to as upward and downward directions, respectively, while a direction along the board 730 is referred to as a horizontal direction.

Herein, the SMEC 720 itself has a low height so that, among light beams emitted by the LED 750, most of the light beams having upward optical paths and obliquely upward optical paths are not interrupted by the SMEC 720. However, a horizontal optical path and some of the obliquely upward optical paths which are nearly horizontal are interrupted by the SMEC 720.

For example, a light beam emitted by the LED 750 in a direction depicted by an arrow A1 in the figure is not interrupted by the SMEC 720 while a light beam emitted by the LED 750 in a direction depicted by an arrow A2 in the figure is interrupted by the SMEC 720.

As mentioned above, there is a problem that the connector interrupts some of the light beams emitted by the LED along the board and, as a result, causes a reduction in amount of outgoing light emitted by an illumination device comprising the LED as a light source.

SUMMARY OF THE INVENTION

Problem to be Solved by the Invention

This invention has been made in view of the above-mentioned situation. It is an object of this invention to provide a connector which is adapted to be mounted to a board and to receive a linear conductor so as to electrically connect a contact formed on the board and the linear conductor and which does not interrupt an optical path in a direction along an upper surface of the board.

Means for Solving the Problem

One aspect of the present invention is a connector comprising a mounting portion of a plate-like shape and a cable fitting portion protruding from the mounting portion in a first direction; the mounting portion having: a first flat surface faced to the first direction; a second flat surface faced to a second direction opposite to the first direction; a fixing portion adapted to be fixed to a board and disposed on the first flat surface; and a flat portion disposed on the second flat surface; the cable fitting portion having: a receiving portion adapted to receive a cable; an opening portion formed at one end of the receiving portion and allowing the cable to pass therethrough; and a cable contact portion to be electrically connected to the cable is provided.

Another aspect of the present invention is an illuminating device comprising a board having a first principal surface, a second principal surface, and a through hole; a light emitting portion disposed on the second principal surface, and a connector; the connector comprising a mounting portion of a plate-like shape and a cable fitting portion protruding from the mounting portion in a first direction; the mounting portion having: a first flat surface faced to the first direction; a second flat surface faced to a second direction opposite to the first direction; a fixing portion adapted to be fixed to a board and disposed on the first flat surface; and a flat portion disposed on the second flat surface; the cable fitting portion having: a receiving portion adapted to receive a cable; an opening portion formed at one end of the receiving portion and allowing the cable to be inserted therethrough; and a cable contact portion to be electrically connected to the cable; the cable fitting portion protruding from the second principal surface through the through hole onto the first principal surface, the fixing portion being fixed to the second principal surface.

Effect of the Invention

According to the one aspect of this invention, when the connector is mounted to the board, the mounting portion protrudes from one surface of the board while the cable fitting portion protrudes from the other surface of the board. As the mounting portion is formed by a plate-like member, it is possible to lower a protruding height of the connector on a side of the mounting portion.

MODE FOR CARRYING OUT THE INVENTION

Figure 1:
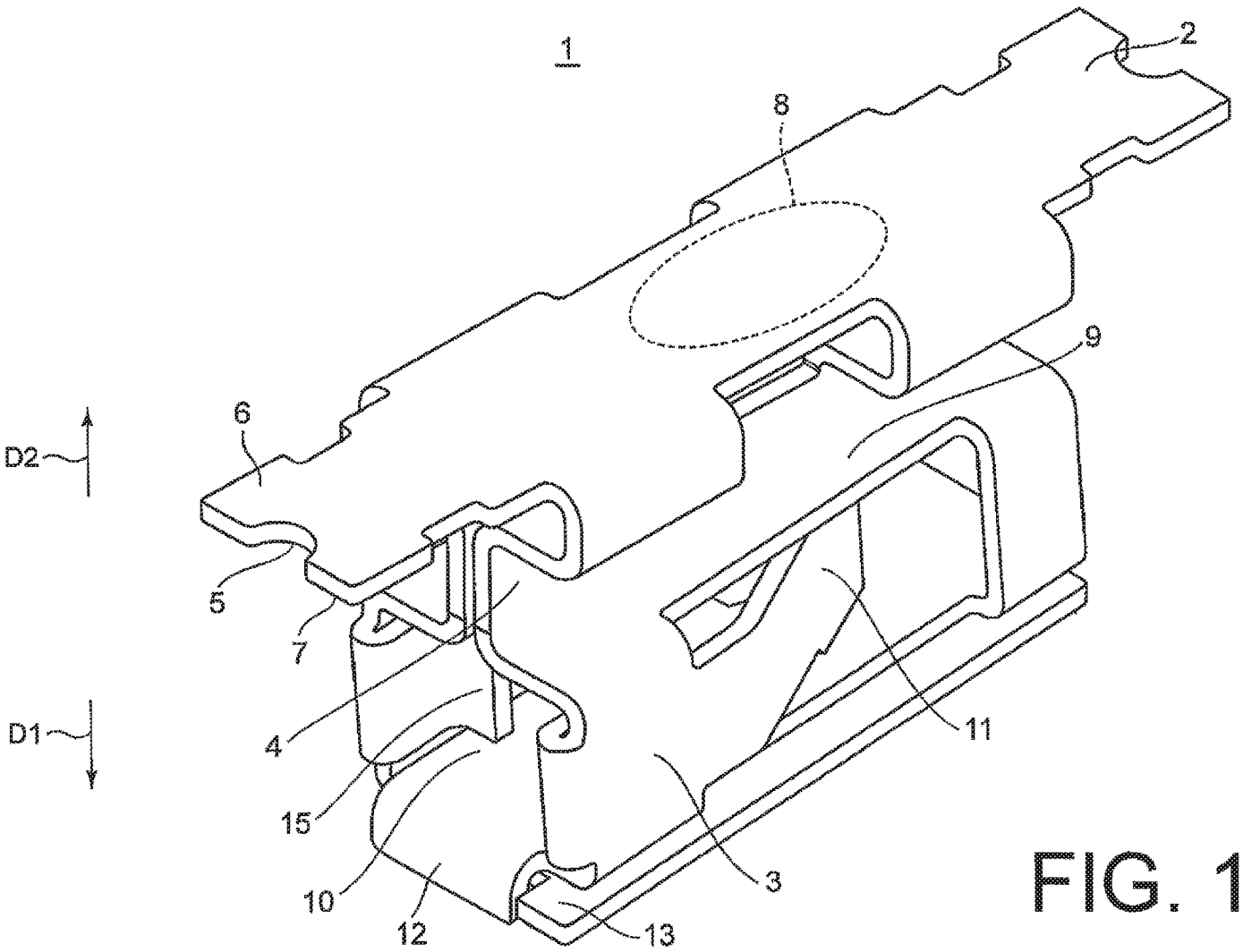
FIG. 1 is a top perspective view of a connector 1 according to one embodiment of this invention.
Figure 2:
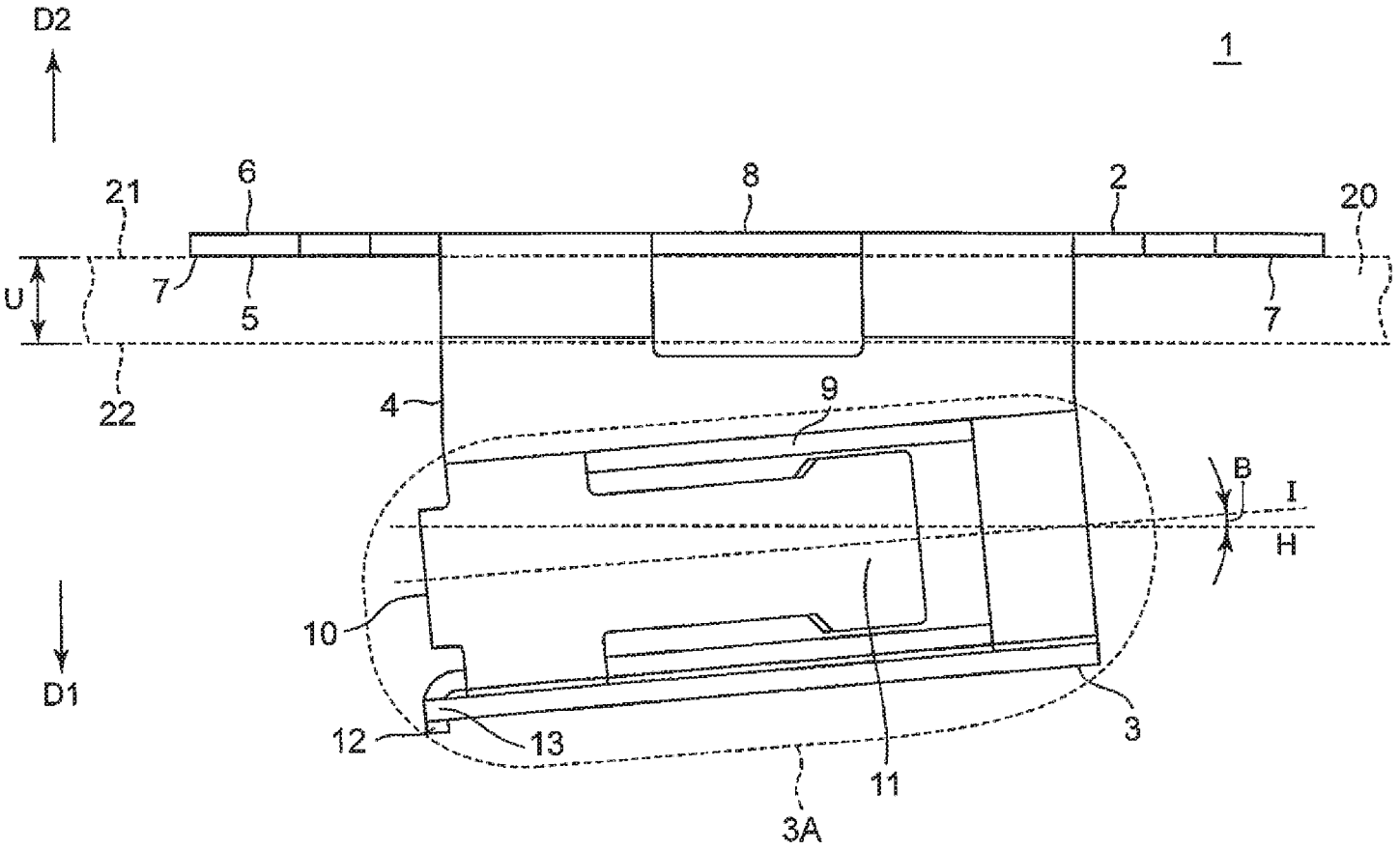
FIG. 2 is a side view of the connector 1.
Figure 3:
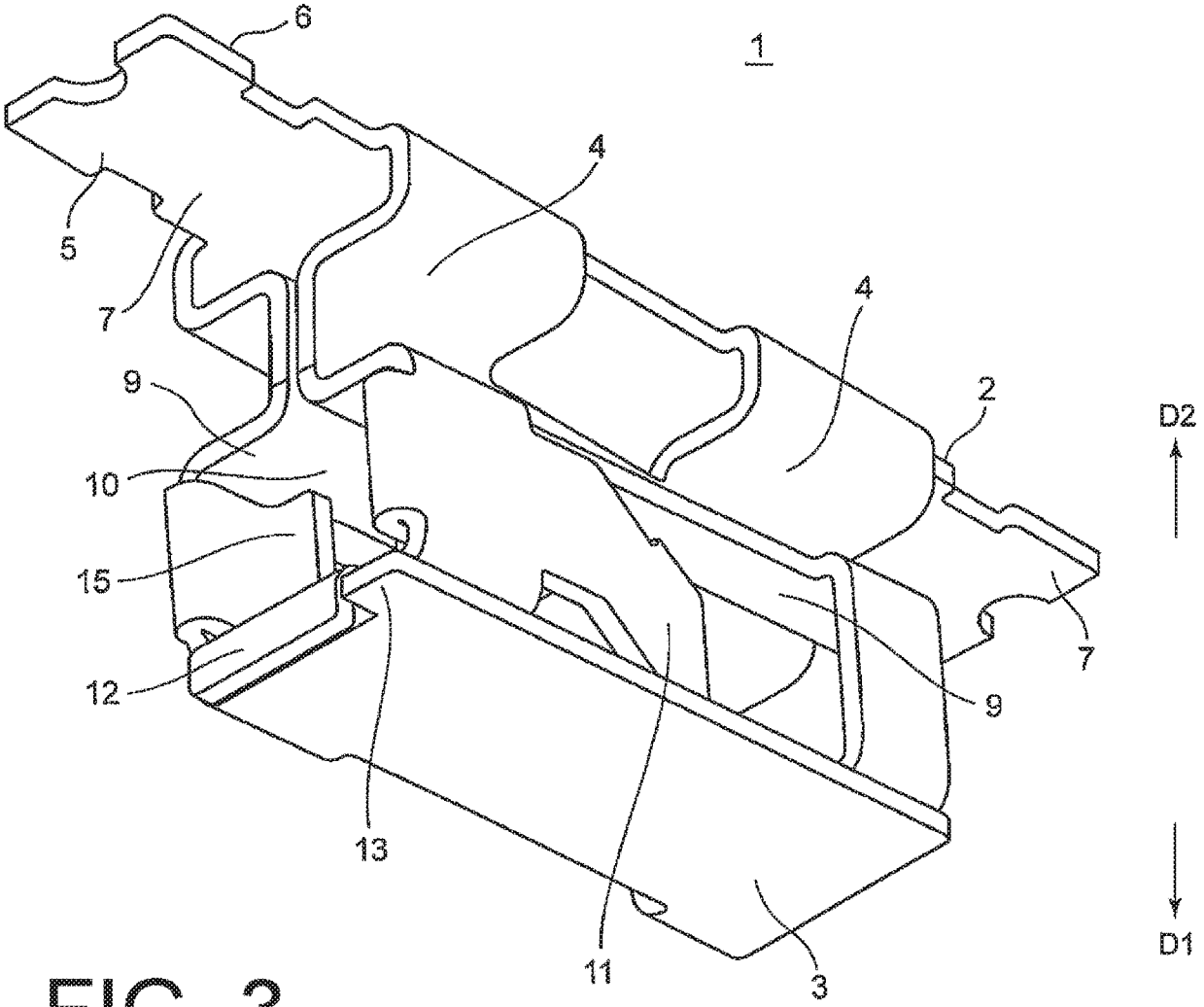
FIG. 3 is a bottom perspective view of the connector 1.
Figure 12:
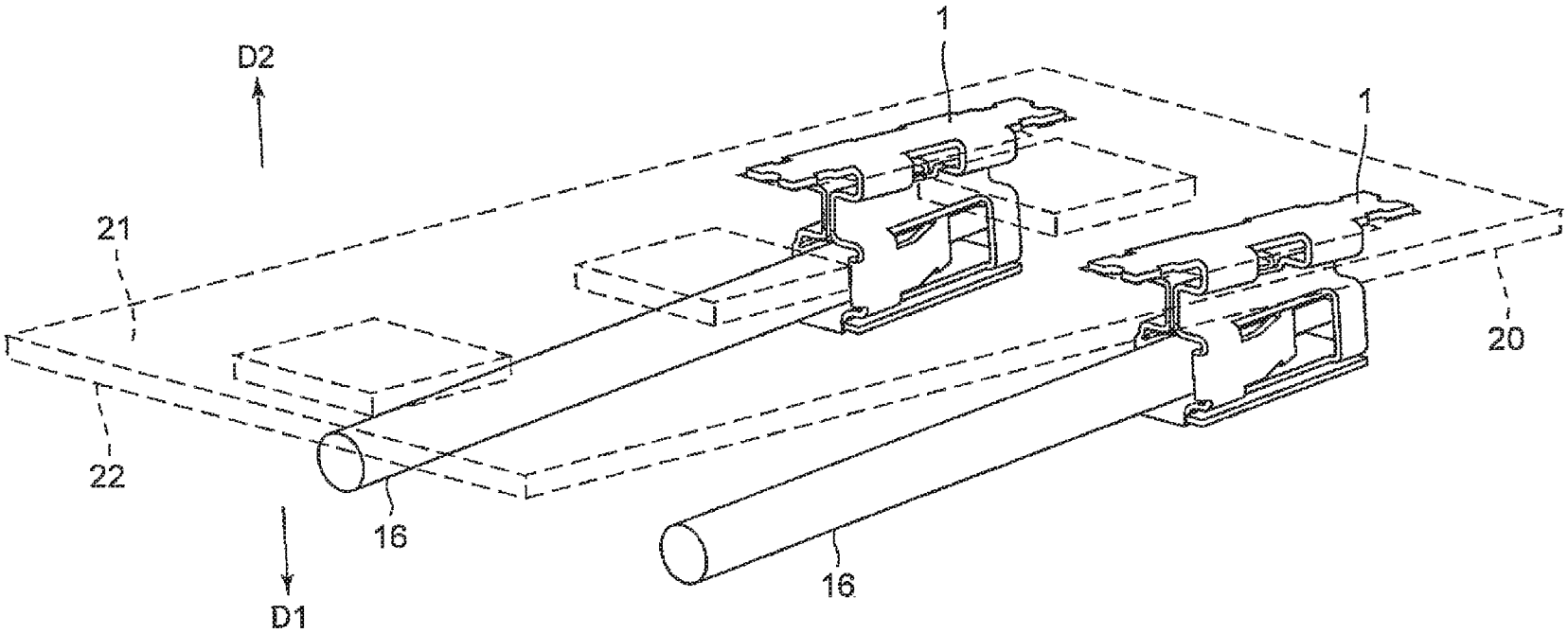
FIG. 12 is a perspective view showing a state where the coated conductor 16 is inserted into each of the two connectors 1 mounted to the board 20.

Referring to FIGS. 1 to 3, description will be made of a connector 1 according to one embodiment of this invention. The connector 1 illustrated in the figures comprises a mounting portion 2 to be mounted to a board 20 (FIG. 12 and so on) and a cable fitting portion 3 adapted to receive a cable as a linear conductor. The cable fitting portion 3 illustrated in the figures is formed on a bottom side of the mounting portion 2 towards a first direction D1. As will later be described, the mounting portion 2 and the cable fitting portion 3 are formed by bending one metal plate cut into a predetermined shape.

The mounting portion 2 is a plate-like member. As illustrated in FIG. 1, the plate-like member forming the mounting portion 2 has two surfaces, i.e., a first flat surface 5 (or a lower surface 5) and a second flat surface 6 (or an upper surface 6). The first flat surface 5 faces a bottom side in the figure, towards the first direction D1. The second flat surface 6 faces a top side in the figure, towards a second direction D2 opposite to the first direction D1.

Figure 13:
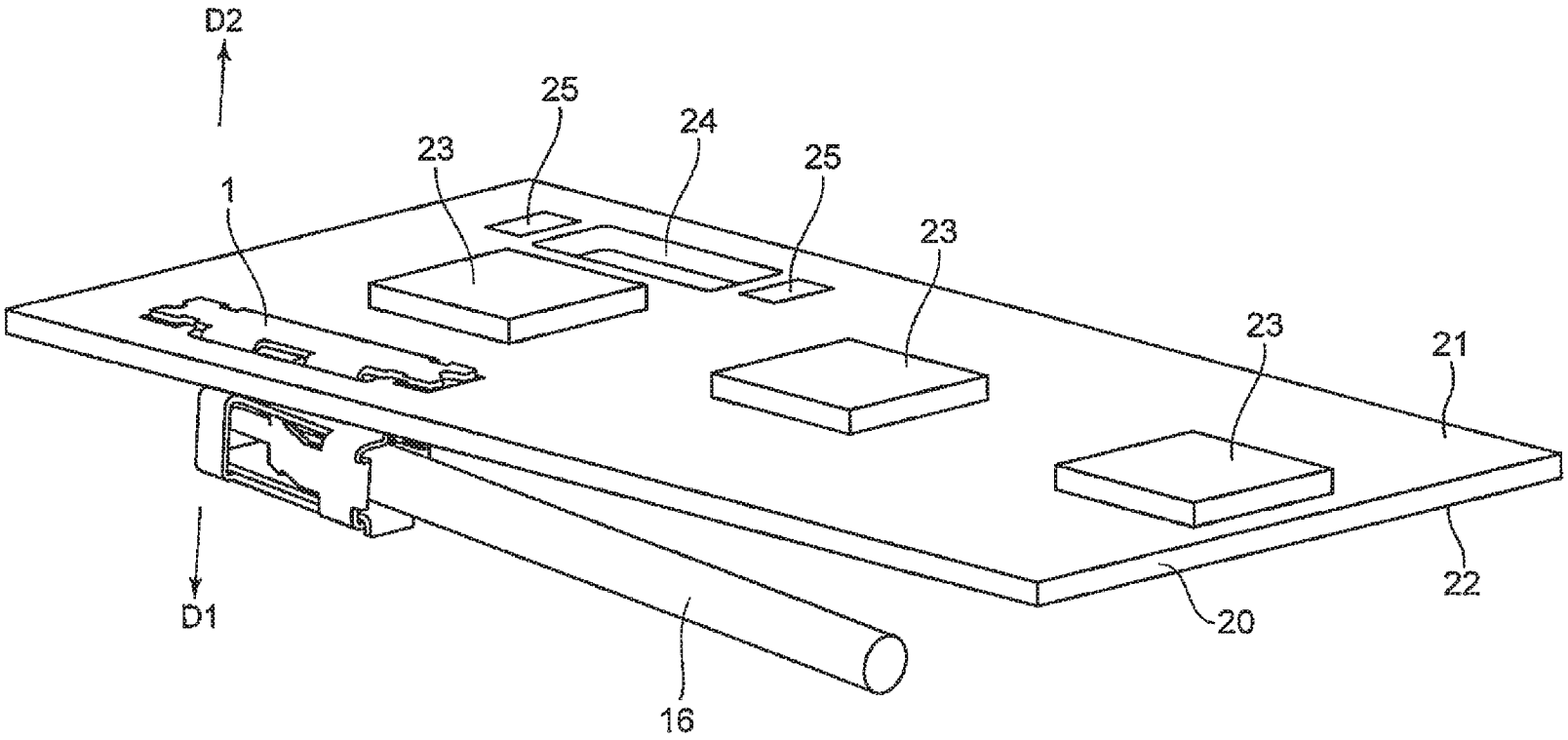
FIG. 13 is a perspective view showing a state where the coated conductor 16 is inserted into the connector 1 mounted to the board 20.

The mounting portion 2 has board contact portions 7 (fixing portions) 7 on the first flat surface 5 at opposite ends in a longitudinal direction. The board contact portions 7 may be called surface mount technology (SMT) portions 7. When the connector 1 is mounted on a surface of the board 20, the board contact portions 7 are electrically connected to board conductors 25 (FIG. 13) formed on a mount surface 21 of the board 20 which will later be described.

The mounting portion 2 has a sucking portion 8 in an area around a center of the second flat surface (upper surface) 6 in the longitudinal direction and a transverse direction. When the connector 1 is held by a collet, a suction port at an end of the collet is brought into contact with the sucking portion 8. The collet is a sucking nozzle for use when an automatic mounting apparatus sucks a part to be mounted. The collet has, at its end, the suction port to be brought into contact with the part to be mounted. The sucking portion 8 is flat. Therefore, when the collet sucks the connector 1, no gap is formed between the end of the collet and the sucking portion 8. The sucking portion 8 is formed around the center of the mounting portion 2. Therefore, during suction by the collet, the connector 1 hardly loses its balance. The collet can hold the connector 1 while keeping the connector 1 in a stable position.

As illustrated in FIG. 2, the cable fitting portion 3 has a receiving portion 3A as a main portion to receive the cable, and a connecting portion 4 for connecting the receiving portion 3A to the mounting portion 2. The receiving portion 3A has an upper cover 9 and cable contact portions 11. The cable contact portions 11 are arranged below the upper cover 9.

The receiving portion 3A has an opening 10 opened on a left side in FIGS. 1 to 3. When a coated conductor 16 (which will later be described with reference to FIG. 7 and so on) is inserted through the opening 10, the receiving portion 3A receives the coated conductor 16. Therefore, the opening 10 is located at a position dependent on a thickness U of the board 20 to which the connector 1 is to be mounted. When the connector 1 is mounted to the board 20, the opening 10 is exposed from the board 20 at least to the extent that the coated conductor 16 can be inserted. In FIG. 2, the opening 10 is completely exposed from the board 20. The receiving portion 3A has the cable contact portions 11 arranged inside thereof behind the opening 10. The cable contact portions 11 are contacted with a bare conductor 17A exposed from a cover 18 of the coated conductor 16.

The connecting portion 4 connecting the mounting portion 2 and the receiving portion 3A has bridging portions connecting the mounting portion 2 and the upper cover 9. In this embodiment, the bridging portions of the connecting portion 4 obliquely connect the mounting portion 2 and the receiving portion 3A. As will later be described, the coated conductor 16 is inserted into the receiving portion 3A in an inserting direction depicted by a dotted line I in FIG. 2. A dotted line H indicates a horizontal plane parallel to the first and the second flat surfaces 5 and 6 of the mounting portion 2. When the connector 1 is mounted to the board 20, the mount surface 21 and a rear surface 22 of the board 20 (which will later be described) are also parallel to the dotted line H. As illustrated in the figure, the dotted line I is inclined at an angle B with respect to the dotted line H. In the following description, the inserting direction depicted by the dotted line I may be briefly called the inserting direction I. Similarly, the horizontal plane depicted by the dotted line H may be briefly called the horizontal plane H.

Thus, the inserting direction I is not parallel to the horizontal plane H (the first and the second flat surfaces 5 and 6 of the mounting portion 2). Therefore, the dotted line (or its extension) indicating the inserting direction I intersects with a flat plane defined by the mounting portion 2. Similarly, when the connector 1 is mounted to the board 20 which will later be described, the inserting direction I also intersects with the board 20 arranged along the first flat surface 5.

The inclination angle B is provided to the receiving portion 3A in order to facilitate an operation of inserting the coated conductor 16 through the opening 10.

Description will be made further in detail. At first, it is assumed that the connector 1 is mounted to the board 20 and the coated conductor 16 is not yet inserted into the connector 1. Next, it is assumed that, in order to insert the coated conductor 16 into the receiving portion 3A, an operator holds the coated conductor 16 and brings an end of the coated conductor 16 close to the opening 10. In this case, it is assumed that the end of the coated conductor 16 is located just in front of the opening 10 and the operator holds the coated conductor 16 at a position slightly apart from its end.

At that time, because the inclination angle B is provided, the position of the coated conductor 16 that is held by the operator is farther from the board 20 than the end of the coated conductor 16. Therefore, as compared with a case where the inserting direction I is parallel to the horizontal plane H without the inclination angle B, a wider space can be secured between fingertips of the operator and the board 20 so that the operator can easily perform the operation.

Figure 4:
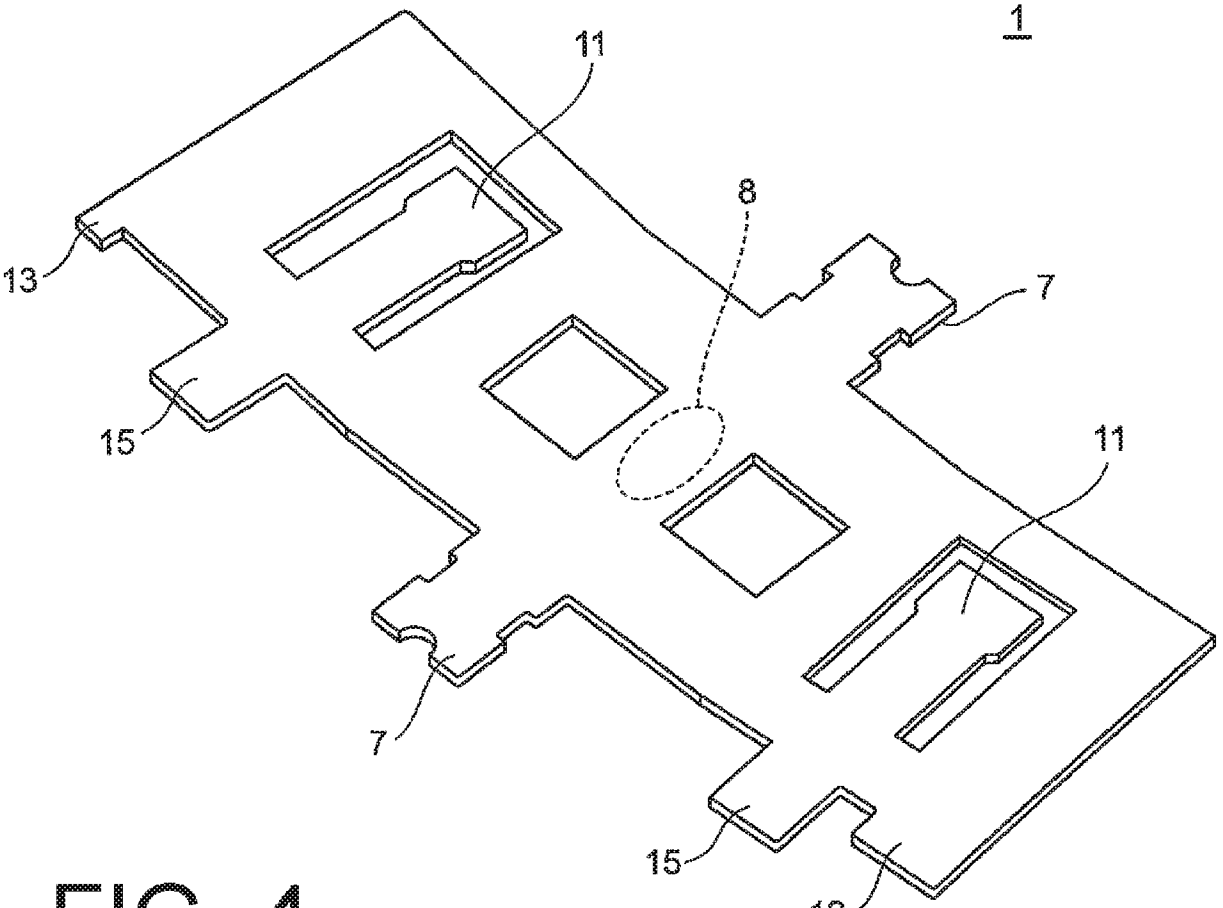
FIG. 4 is a perspective view of a metal plate forming the connector 1 in an expanded state.

The above-mentioned connector 1 is formed by bending one metal plate as illustrated in FIG. 4. Accordingly, there is an advantage that the connector 1 requires a small number of parts and a manufacturing cost is easily reduced.

On the other hand, such a bending structure of the metal plate causes another problem. Simply stated, in the connector 1, the mounting portion 2, the receiving portion 3A, and the connecting portion 4 are formed by bending the metal plate of a generally rectangular shape in a longitudinal direction and then overlapping opposite end regions including short sides, as will be understood from FIG. 4. Due to the bending structure of the metal plate, the connector 1 may possibly be deformed if an external force is applied in an unbending direction.

Specifically, when the coated conductor 16 is inserted into the receiving portion 3A through the opening 10, a force such that the end of the coated conductor 16 presses inner walls of the receiving portion 3A may be applied as an external force in a direction backward or frontward from a plane of a drawing sheet of FIG. 2. In order to resist the external force and to prevent the receiving portion 3A from being deformed, the receiving portion 3A has a bending portion 12 and a projecting portion 13.

Figure 5:
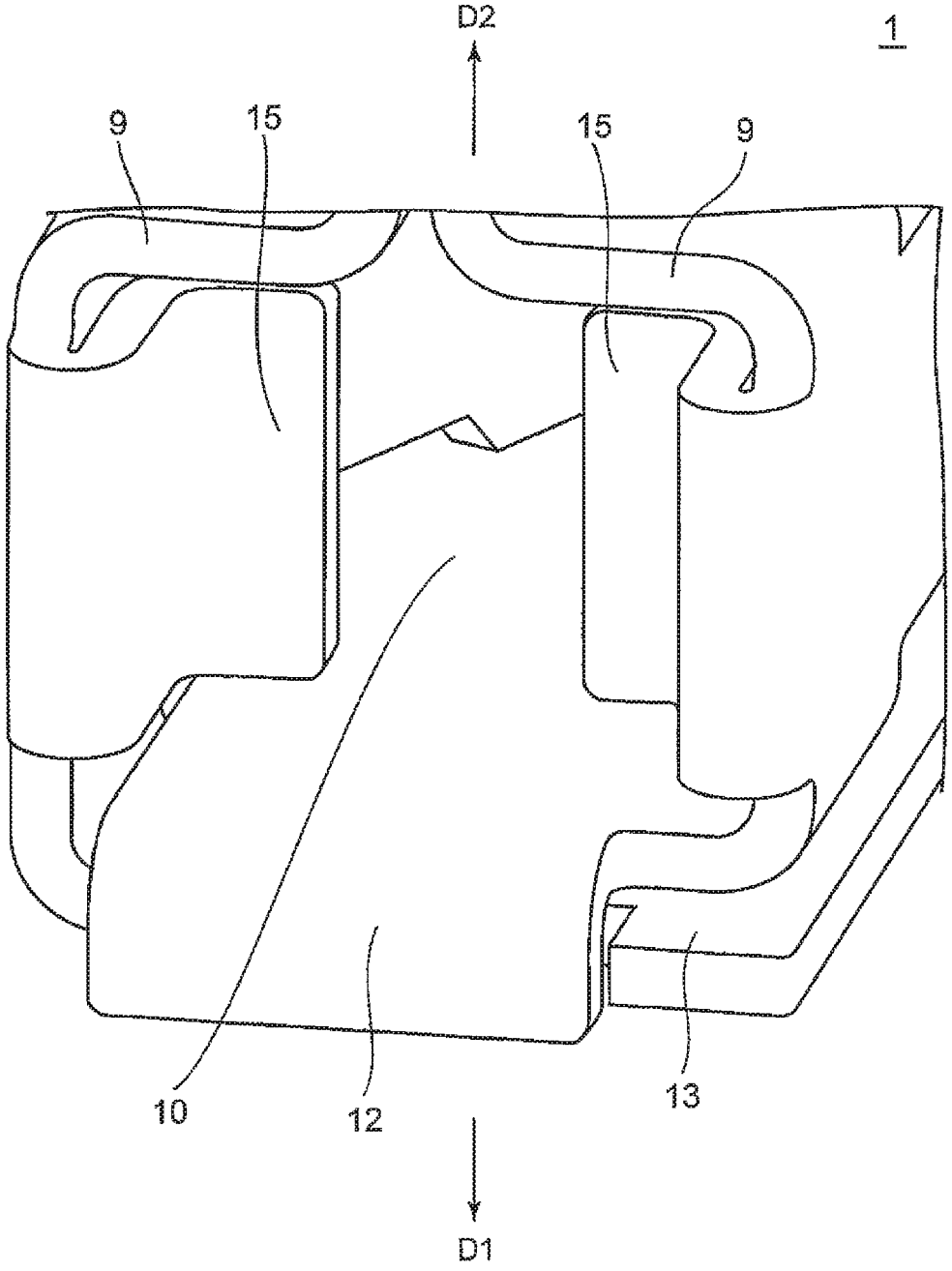
FIG. 5 is a partial perspective view of the connector 1 for describing that a bending portion 12 and a projecting portion 13 prevent enlargement in width of the opening 10.
Figure 6:
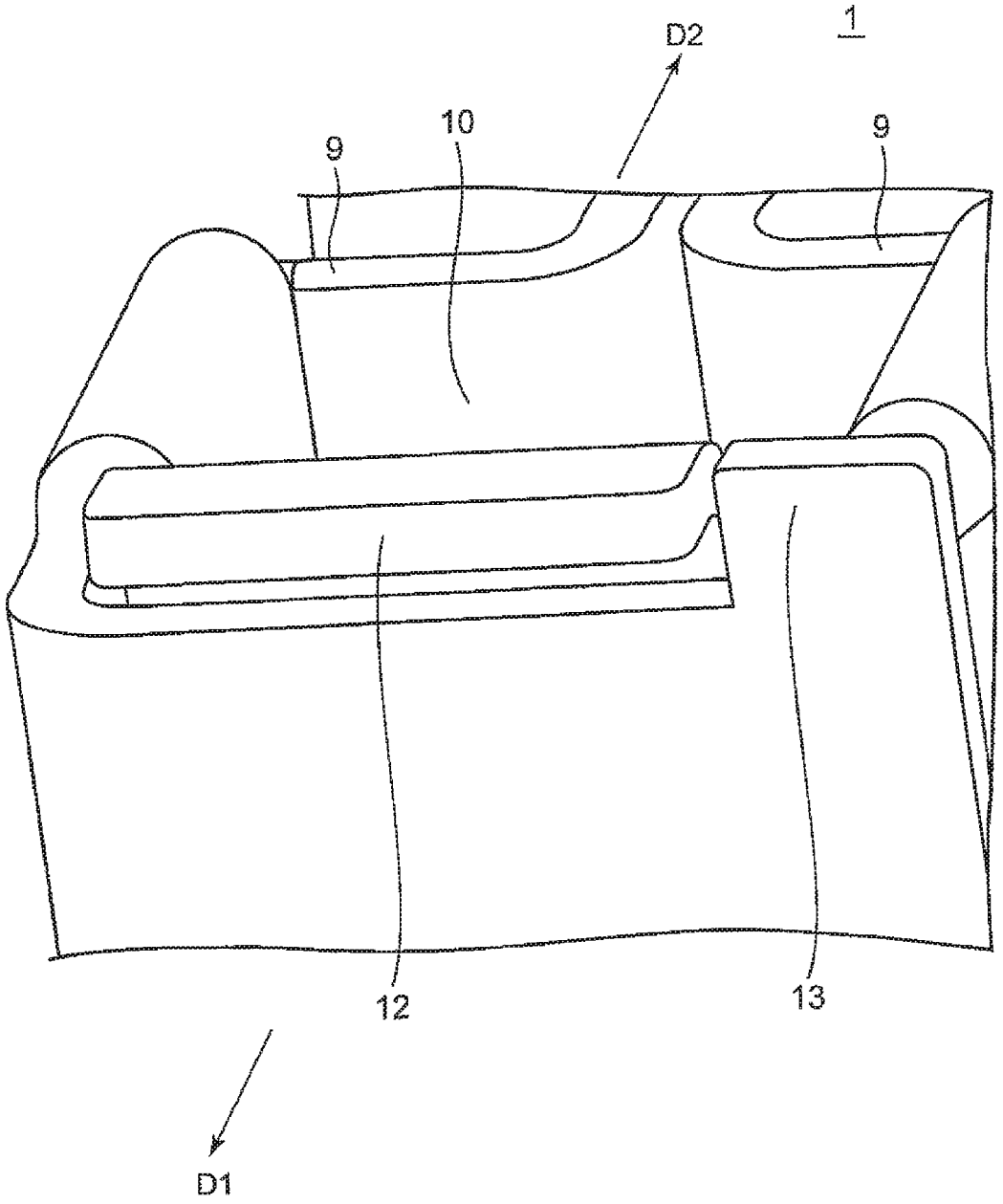
FIG. 6 is a partial perspective view of the connector 1 for describing that the bending portion 12 and the projecting portion 13 prevent enlargement in width of the opening 10.

As illustrated in FIG. 4, the metal plate forming the connector 1 has a generally rectangular shape. In particular, the structure of the receiving portion 3A is formed, simply stated, by bending and winding the metal plate in a longitudinal direction of the rectangular shape. At a final stage of forming the receiving portion 3A, the bending portion 12 is bent outward from the opening 10 as illustrated in FIGS. 5 and 6. Consequently, the bending portion 12 and the projecting portion 13 are arranged to be engaged with each other. Due to the engagement, the opening 10 is prevented from being deformed even if a force is applied to the opening 10 in a direction of widening the width of the opening 10.

Figure 7:
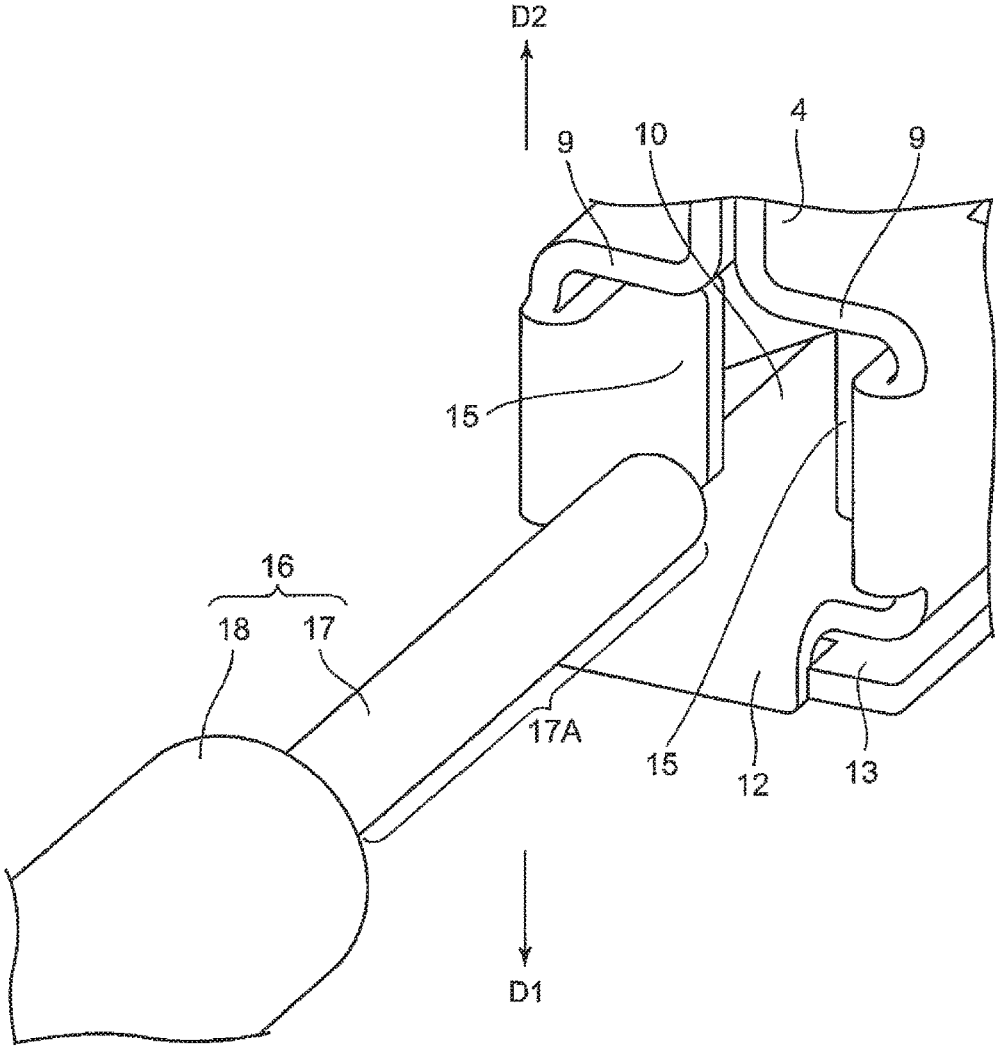
FIG. 7 is a perspective view for describing that a cable stopper 15 formed behind the opening 10 stops insertion of a coated conductor 16 at a predetermined position.

As illustrated in FIG. 7, the receiving portion 3A is provided with the opening 10 of a quadrilateral shape formed at its one end. The coated conductor 16 is inserted into the opening 10. The coated conductor 16 has a conductor 17 and the cover 18. A part of the cover 18 at the end of the coated conductor 16 is removed to expose the bare conductor 17A. Behind the opening 10, cable stoppers 15 are provided so as to narrow the width of the opening 10 in a transverse direction in the figure.

The cable stoppers 15 comprise two plate-like members protruding from the inner walls, left and right in the figure, of the receiving portion 3A behind the opening 10, respectively, in a direction intersecting the inserting direction I along which the coated conductor 16 is inserted.

If a state where the coated conductor 16 is received in the receiving portion 3A is seen through in the inserting direction I, the two plate-like members overlap the cover 18 and do not overlap the conductor 17. For example, in case where the coated conductor 16 has a circular section, a gap between the two plate-like members is wider than a diameter of the bare conductor 17A and is narrower than a diameter of the coated conductor 16 including the cover 18. Therefore, the bare conductor 17A without the cover 18 is allowed to pass through the gap between the cable stoppers 15 while the cover 18 cannot pass through the gap between the cable stoppers 15. Thus, the cable stoppers 15 interfere with an end of the cover 18 so as to prevent the coated conductor 16 from moving further backward in the receiving portion 3A.

By providing the cable stoppers 15, a load of an operation of connecting the coated conductor 16 to the connector 1 is reduced. When the coated conductor 16 is connected to the connector 1, it is necessary to insert the coated conductor 16 into the receiving portion 3A by an appropriate length as an insertion length. If the cable stoppers 15 are not provided, for example, the operator must put, on the coated conductor 16, a mark representative of the insertion length of the coated conductor 16, and thereafter insert the coated conductor 16 through the opening 10. However, by providing the cable stoppers 15 at an appropriate position of the receiving portion 3A, the operator is only required to insert the coated conductor 16 with the bare conductor 17A exposed from its end until he feels a touch of interference. Thus, it is not necessary, for example, to preliminarily provide the mark representative of the insertion length at the end of the coated conductor 16.

As described in conjunction with FIG. 4, the connector 1 is formed by bending one metal plate. The metal plate is made of a material harder than the conductor 17. The cable contact portions 11 are formed on a pair of flat plates formed by bending the one metal plate, respectively.

Figure 10:
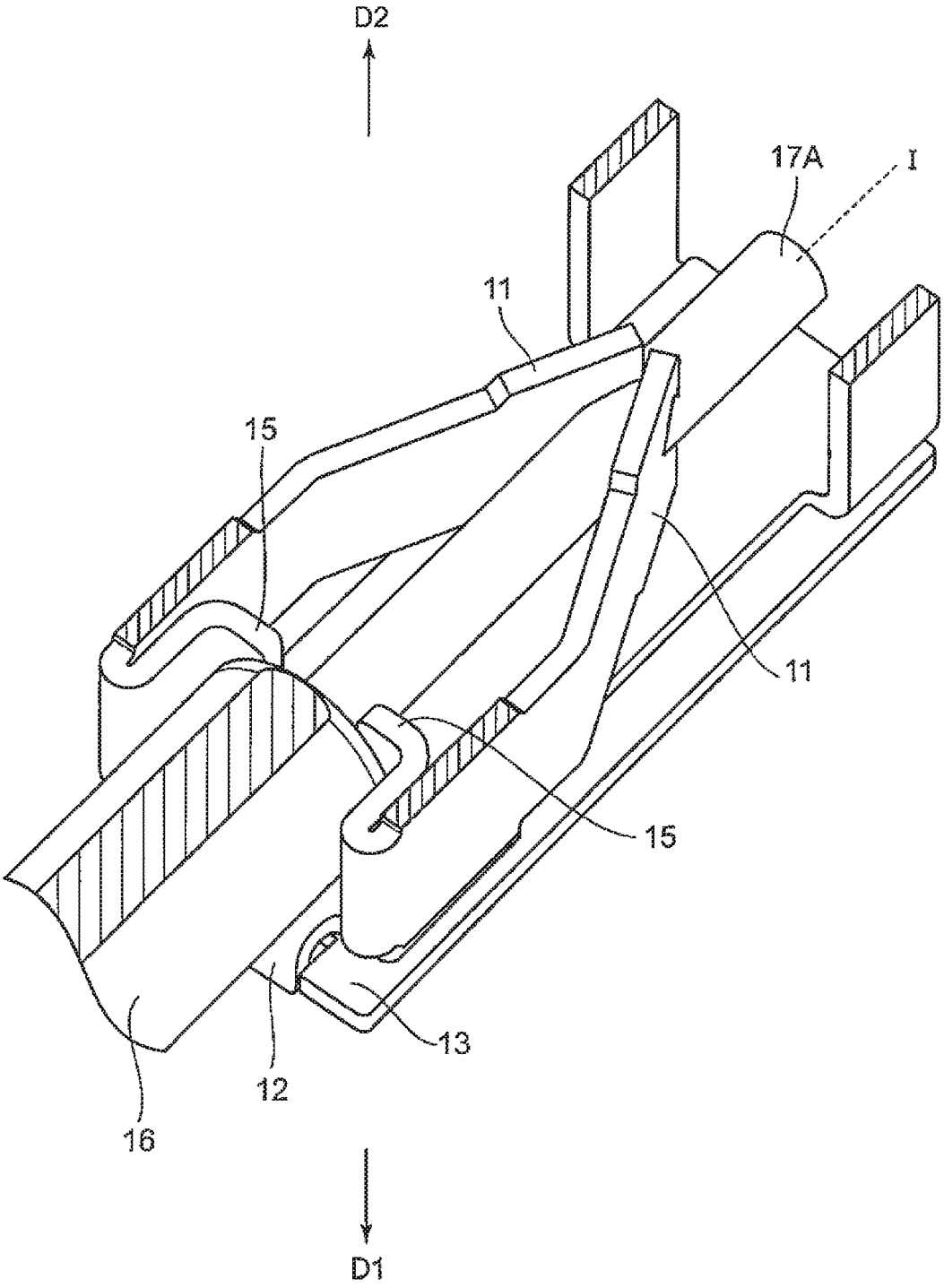
FIG. 10 is a sectional view, taken along a line B-B in FIG. 9, for describing a state where the cable contact portion 11 bites into a conductor 17.
Figure 11:
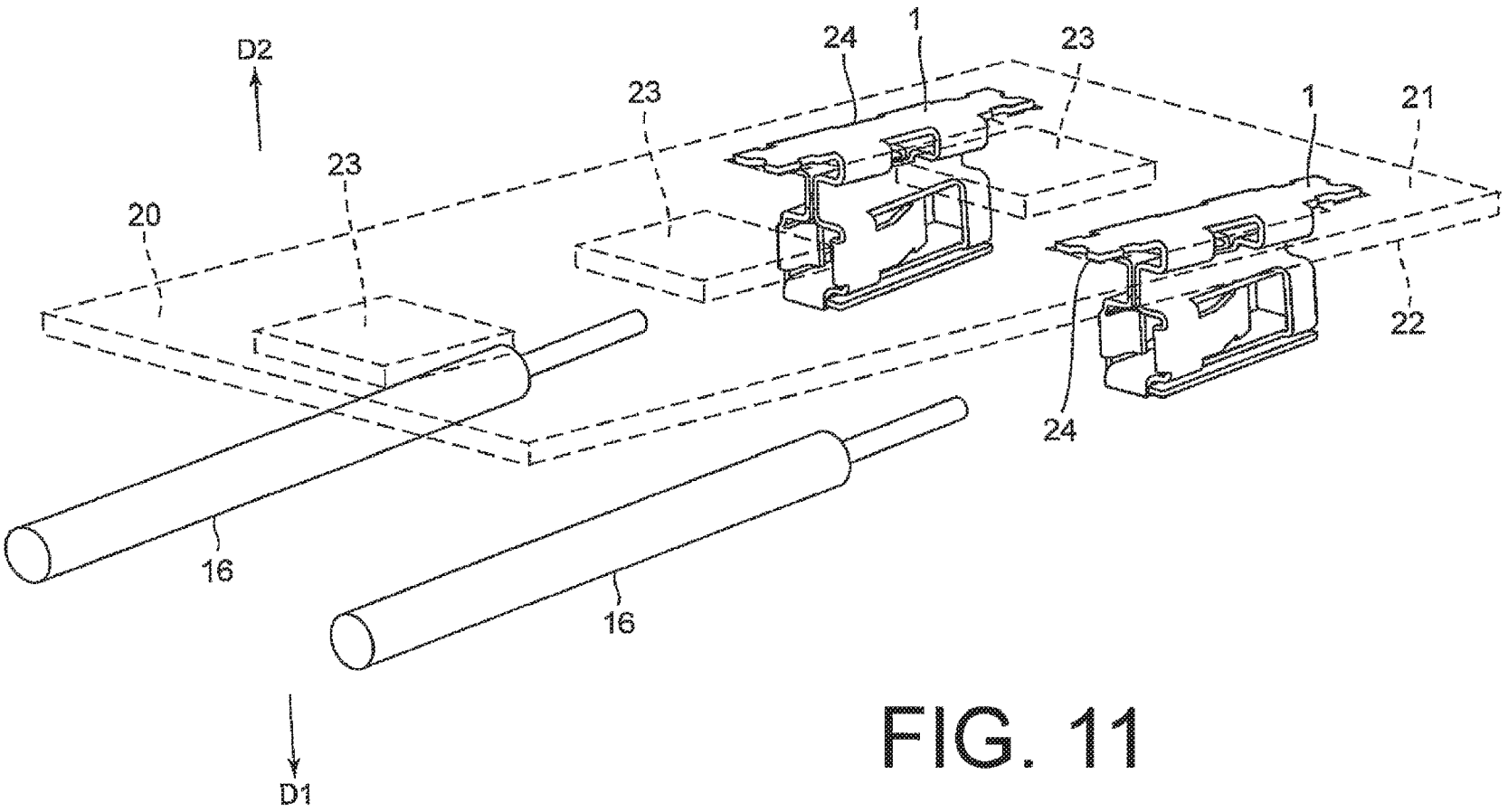
FIG. 11 is a perspective view showing a state immediately before the coated conductor 16 is inserted into each of two connectors 1 mounted to a board 20.

Referring to FIG. 2, the inserting direction of inserting the coated conductor 16 through the opening 10 into the receiving portion 3A along the dotted line I may be referred to as backward while an opposite direction, i.e., an extracting direction of extracting the coated conductor 16 received in the receiving portion 3A may be referred to as frontward. Then, as illustrated in FIG. 10, frontward one ends of the pair of the flat plates are fixed to the receiving portion 3A. Each of the flat plates configures a cantilever beam having a fixed end fixed to the receiving portion 3A.

Each of the flat plates extends from the receiving portion 3A in the inserting direction I and then bends inward, i.e., in a direction obliquely intersecting with the inserting direction I, to form a bend. Thereafter, each of the flat plates straightly extends from the bend. By the bends, the cable contact portions 11 form a taper which is wide frontward and narrow backward. With the bends, the cable contact portions 11 act as leaf springs elastically deformed in response to insertion of the coated conductor 16.

When the coated conductor 16 is not inserted, the cable contact portions 11 are located at a position to block a moving path of the coated conductor 16 which is going to be inserted. Specifically, the cable contact portions 11, i.e., free ends of the two cantilever beams are arranged to be contacted with each other. Alternatively, the free ends may be arranged to have a gap therebetween. In this case, the gap must have a length such that the end of the coated conductor 16, i.e., the bare conductor 17A is contacted with both of the free ends when it is inserted. For example, in case where the bare conductor 17A has a circular section, the two free ends are arranged so that the gap therebetween is narrower than the diameter of the bare conductor 17A.

When the coated conductor 16 is inserted through the opening 10 and gradually advanced, an end of the bare conductor 17A is obliquely brought into contact with both of the two metal plates forming the cable contact portions 11.

This is because the two free ends are arranged to block the moving path of the coated conductor 16 as described above.

After the end of the bare conductor 17A is contacted with the cable contact portions 11, the coated conductor 16 is continuously inserted further. Then, in response to a pressing force from the bare conductor 17A, the two metal plates are elastically deformed as the leaf springs to widen an end of the taper. Concurrently, the end of the bare conductor 17A advances while sliding over slopes formed by surfaces of the cable contact portions 11. As described above, when the coated conductor 16 is not inserted, the cable contact portions 11 block the moving path of the coated conductor 16. However, since the taper of the cable contact portions 11 is formed by the metal plates elastically deformable, the cable contact portions 11 are responsive to the pressing force of the end of the bare conductor 17A to perform an operation like a double swing door being opened.

When the coated conductor 16 is further advanced, the end of the bare conductor 17A reaches end portions of the slopes formed by the surfaces of the cable contact portions 11, i.e., the free ends of the cantilever beams. When each of the conductor 17 and the cover 18 has a circular section, the two free ends are faced to each other with the end of the bare conductor 17A interposed therebetween and the diameter of the bare conductor 17A coincides with the length of the gap between the two free ends. When the coated conductor 16 is further advanced, the end of the bare conductor 17A passes over the cable contact portions 11 to move backward. At this time, the cable contact portions 11 are pressed against a side surface of the bare conductor 17A due to an elastic force and slide along the side surface of the bare conductor 17A. The end of the taper is opened by a length corresponding to the diameter of the bare conductor 17A and, while the bare conductor 17A slides through the end of the taper thus opened, the coated conductor 16 moves backward of the receiving portion 3A. Herein, it is assumed that each of the conductor 17 and the cover 18 has a sectional shape other than the circular shape. In this case, because the sectional shape is not circular, it is not a diameter which coincides with the length of the gap between the two free ends when the end of the bare conductor 17A reaches the free ends of the cantilever beams. However, it would be obvious for a skilled person that, when the conductor 17 is received in the receiving portion 3A, a dimension of the conductor 17 corresponding to the width in its sectional shape coincides with the length of the gap between the free ends of the cantilever beams.

Figure 8:
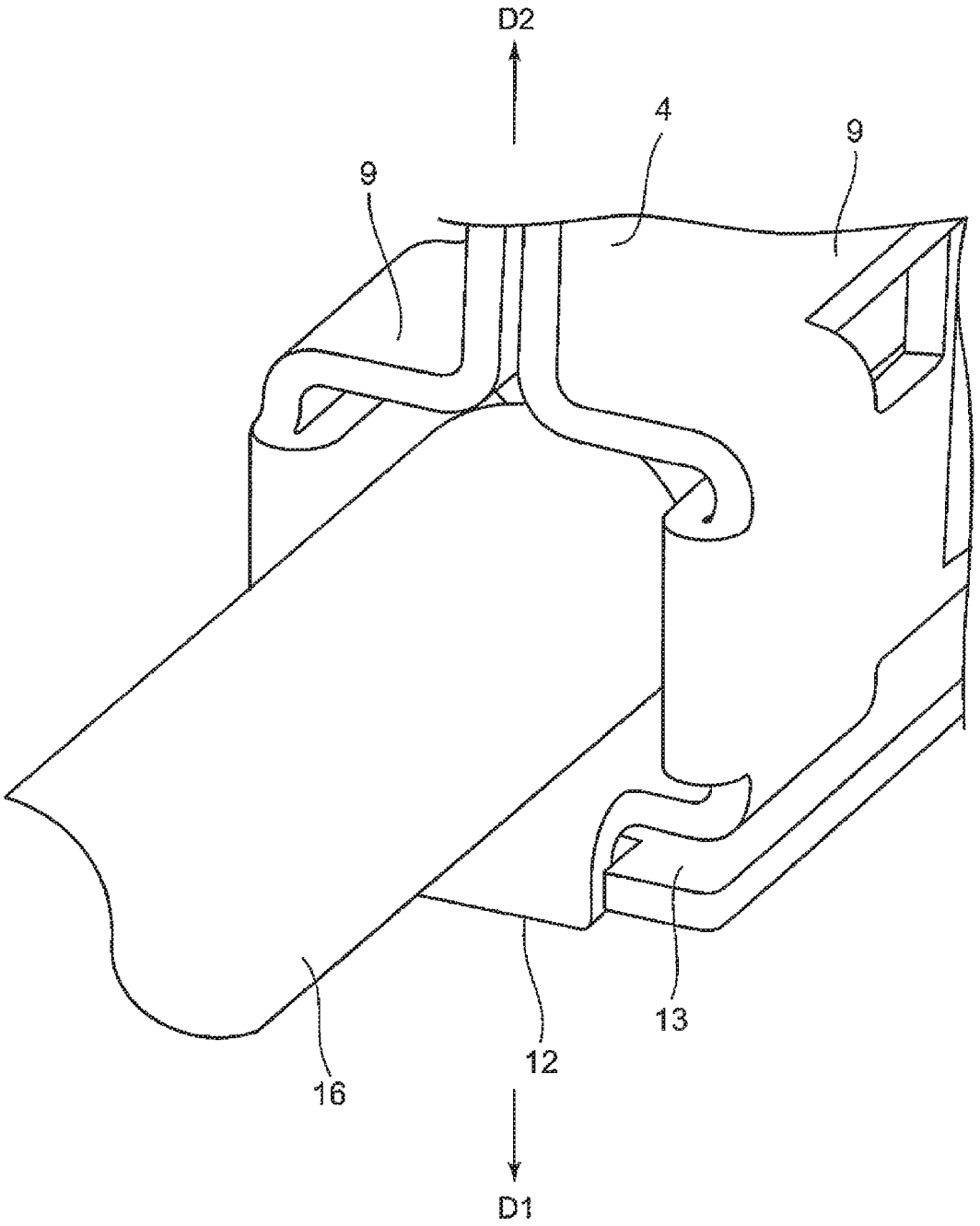
FIG. 8 is a perspective view for describing the connector 1 in a state where the coated conductor 16 is inserted to the predetermined position defined by the cable stopper 15.
Figure 9:
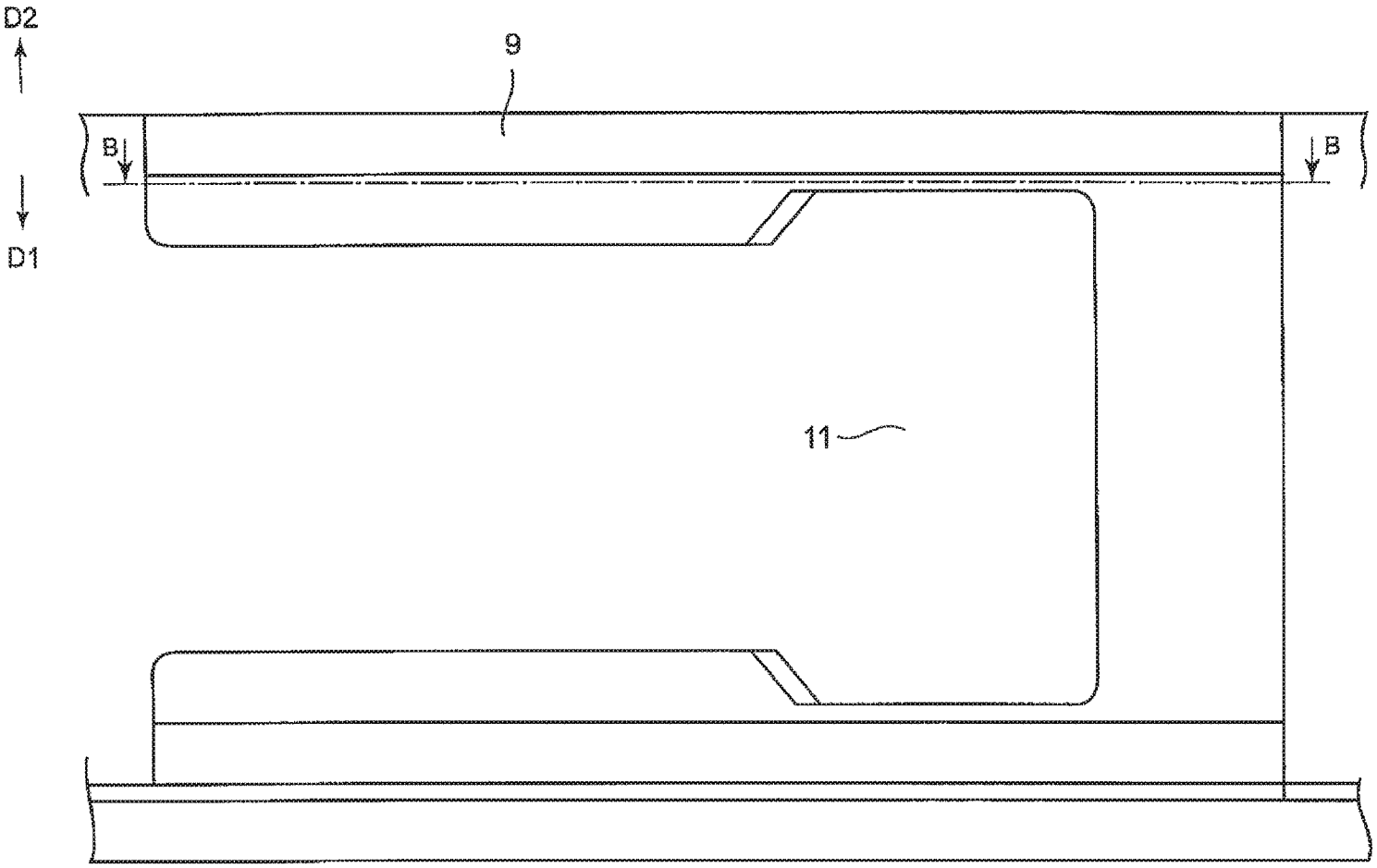
FIG. 9 is an enlarged view of an area around a cable contact portion 11 in FIG. 2.

When the coated conductor 16 is advanced further backward of the receiving portion 3A, the end of the cover 18 eventually interferes with the cable stoppers 15. This state is shown in FIGS. 8 and 10. Because of the interference, the operator who is inserting the coated conductor 16 into the receiving portion 3A can be aware that the coated conductor 16 is inserted to a predetermined position in the receiving portion 3A and the inserting operation is finished. As illustrated in FIG. 10, the two cantilever beams are faced to each other so that the bare conductor 17A inserted into the receiving portion 3A in the inserting direction I is clamped between the free ends of the cantilever beams. Thereafter, the coated conductor 16 thus inserted is received by the receiving portion 3A. At that time, the bare conductor 17A is electrically connected to the cable contact portions 11.

As described above, the two cantilever beams forming the cable contact portions 11, in particular, end portions forward from the bends, form the taper which is wide frontward and narrow backward as seen in the inserting direction I of inserting the coated conductor 16. As seen in the opposite direction, i.e., in the extracting direction of extracting the coated conductor 16, the taper has a reverse tapered structure. The metal plate forming the connector 1 is made of a material harder than the conductor 17. For example, the metal plate forming the connector 1 is a Corson alloy (Cu—Ni—Si) while the conductor 17 is made of soft or annealed copper.

With the above-mentioned structure, the coated conductor 16 is prevented from being released from the connector 1. The cantilever beams press the cable contact portions 11 against the side surface of the bare conductor 17A. Therefore, if a force is applied in the extracting direction of extracting the coated conductor 16 from the connector 1, a frictional resistance is generated between the cable contact portions 11 and the bare conductor 17A to prevent movement and release of the coated conductor 16.

As seen in the extracting direction of extracting the coated conductor 16, the cable contact portions 11 have the reverse tapered structure. Therefore, if a force of the cantilever beams pressing the cable contact portions 11 against the side surface of the bare conductor 17A and a force of extracting the coated conductor 16 are simultaneously applied, ends of the cable contact portions 11 are applied with a force in a direction of obliquely biting into the bare conductor 17A. Since the metal plates forming the cable contact portions 11 are harder than the bare conductor 17A, the ends of the cable contact portions 11 are gradually biting into the side surface of the bare conductor 17A. As a result, as shown in FIG. 10, the ends of the cable contact portions 11 bite into the side surface of the bare conductor 17A to prevent the coated conductor 16 from being released.

Next, description will be made of a process of mounting the connector 1 to the board 20 and a process of inserting the coated conductor 16 into the connector 1 mounted to the board 20. As illustrated in FIGS. 11 to 15, the board 20 has the mount surface 21 located upside in the figure and the rear surface 22 located downside in the figure. On the mount surface 21, three LEDs 23 are mounted. The mount surface 21 and the rear surface 22 correspond to a second principal surface and a first principal surface in appended claims, respectively. The board 20 has a through hole 24 penetrating from the mount surface 21 to the rear surface 22.

The through hole 24 has an opening greater than a footprint of the cable fitting portion 3 and smaller than a footprint of the mounting portion 2. In particular, comparing the opening of the through hole 24, the footprint of the cable fitting portion 3, and the footprint of the mounting portion 2 in the longitudinal direction, the length of the footprint of the cable fitting portion 3 in the longitudinal direction is shorter than the length of the opening of the through hole 24 in the longitudinal direction. Since the mounting portion 2 has the board contact portions 7 extending towards longitudinal opposite ends, therefore, the footprint of the mounting portion 2 is longer in the longitudinal direction than the footprint of the cable fitting portion 3 at least by an amount corresponding to the board contact portions 7. By appropriately selecting a length for providing the board contact portions 7, it is possible to configure the connector 1 so that, when the connector 1 is vertically lowered from a position directly above the through hole 24, the cable fitting portion 3 passes through the through hole 24 to protrude from the rear surface 22 while the mounting portion 2 does not pass through the through hole 24 and the board contact portions 7 are located on the mount surface 21.

Now, it is assumed that the LEDs 23 are already mounted to the board 20 and the connector 1 is not yet mounted. In the above-mentioned state, the connector 1 is held by sucking the sucking portion 8 using the collet, and transported to the position directly above the through hole 24. Then, the cable fitting portion 3 is inserted through the through hole 24. As described above, the mounting portion 2 cannot pass through the through hole 24. Therefore, the board contact portions 7 of the mounting portion 2 are brought into contact with the mount surface 21. Board conductors 25, such as conductor patterns, are arranged around the through hole 24 at positions corresponding to the board contact portions 7. The board conductors 25 are brought into contact with the board contact portions 7. As a consequence, electric connection between the board conductors 25 on the mount surface 21 and the connector 1 is established. If necessary, the board conductors 25 and the board contact portions 7 are bonded by soldering.

As illustrated in FIG. 1, the sucking portion 8 is formed at a position highest from the mount surface 21 of the board 20 when the connector 1 is mounted to the board 20. Therefore, when the connector 1 is sucked by using the collet, the collet and the connector 1 are contacted to each other only at the suction port of the collet and the sucking portion 8. Generally, the suction port of the collet is formed at an end of a main body of the collet. On the other hand, the connector 1 has no part arranged at a position higher than the sucking portion 8 as seen from the mount surface 21. Therefore, the main body of the collet except the suction port and the connector 1 are not contacted with each other.

In the process of mounting the connector 1 to the board 20 by using the collet, i.e., during a period after the connector 1, which is not yet mounted to the board 20, is sucked by the collet and before the connector 1 is mounted to the board 20 and the collet is removed from the connector 1, the collet and the connector 1 are contacted to each other only at the suction port and the sucking portion 8 and are not contacted with each other at any other parts.

Therefore, according to the connector 1, there is an advantage that selection of the shape and the size of the end of the collet used for sucking is flexibly dealt with.

Various shapes of collets are known. Herein, by way of example, the collet has a shape that a tapered truncated cone is arranged at an end of a cylinder. The suction port is opened at a bottom surface at an end of the truncated cone and the other bottom surface is connected to the cylinder. In the collet of the type, the cylinder is greater in diameter than a part around the suction port.

In a conventional connector, a particular collet may not be used to suck the connector because the cylinder of the collet interferes with a part of the connector although the suction port of the collet has a size sufficient to suck the sucking portion 8.

However, in the connector 1, no part is higher than the sucking portion 8 as seen from the mount surface 21. Therefore, even if the cylinder has a relatively large diameter, the collet can be used to suck the connector 1. For example, as seen in an axial direction of the cylinder, the collet may have a size such that an external shape of the collet extends over the mounting portion 2 in the transverse direction or the longitudinal direction.

After the connector 1 is mounted to the board 20 by using the collet, the coated conductor 16 is inserted into the connector 1. As described in conjunction with the connecting portion 4, the inserting direction I of inserting the coated conductor 16 is inclined by the angle B with respect to the first and the second flat surfaces 5 and 6 of the mounting portion 2. Therefore, the inserting direction I is also inclined by the angle B with respect to the board 20. In other words, the inserting direction I extends in a direction intersecting with the board 20. As illustrated in FIG. 2, inclination is given so that a side of the cable fitting portion 3 having the opening 10 is away from the board 20 and the other side without the opening 10 is close to the board 20. A part of the coated conductor 16 that is inserted into the cable fitting portion 3 is held by the cable fitting portion 3 while being kept in the inserting direction I.

As will be understood with reference to FIGS. 11 to 14, in a process of bringing the end of the coated conductor 16, which is not yet inserted into the connector 1, close to the cable fitting portion 3 and inserting the coated conductor 16 into the connector 1, the operator holds the coated conductor 16 in a position along the inserting direction I and brings the coated conductor 16 close to the connector 1. In this process, the coated conductor 16 keeps a position that its end is close to the board 20 and its part away from the end is farther from the board 20. Generally, the operator clamps the coated conductor 16, not at the end thereof, but at a position slightly apart from the end. Therefore, a distance between the coated conductor 16 and the board 20 at the position clamped by the operator is longer than that between the end of the coated conductor 16 and the board 20. As a result, in the connector 1, the operation of inserting the coated conductor 16 is facilitated.

Figure 14:
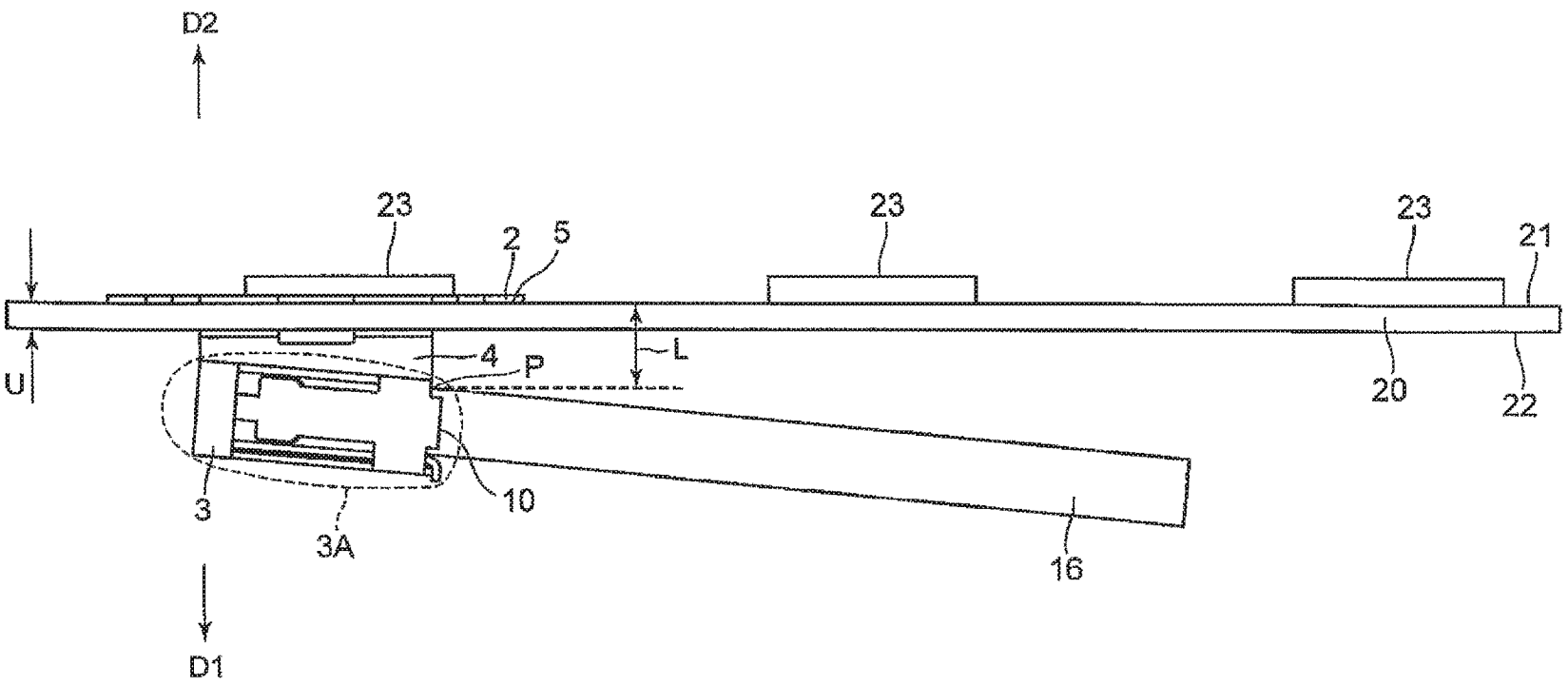
FIG. 14 is a side view showing the state where the coated conductor 16 is inserted into the connector 1 mounted to the board 20.
Figure 15:
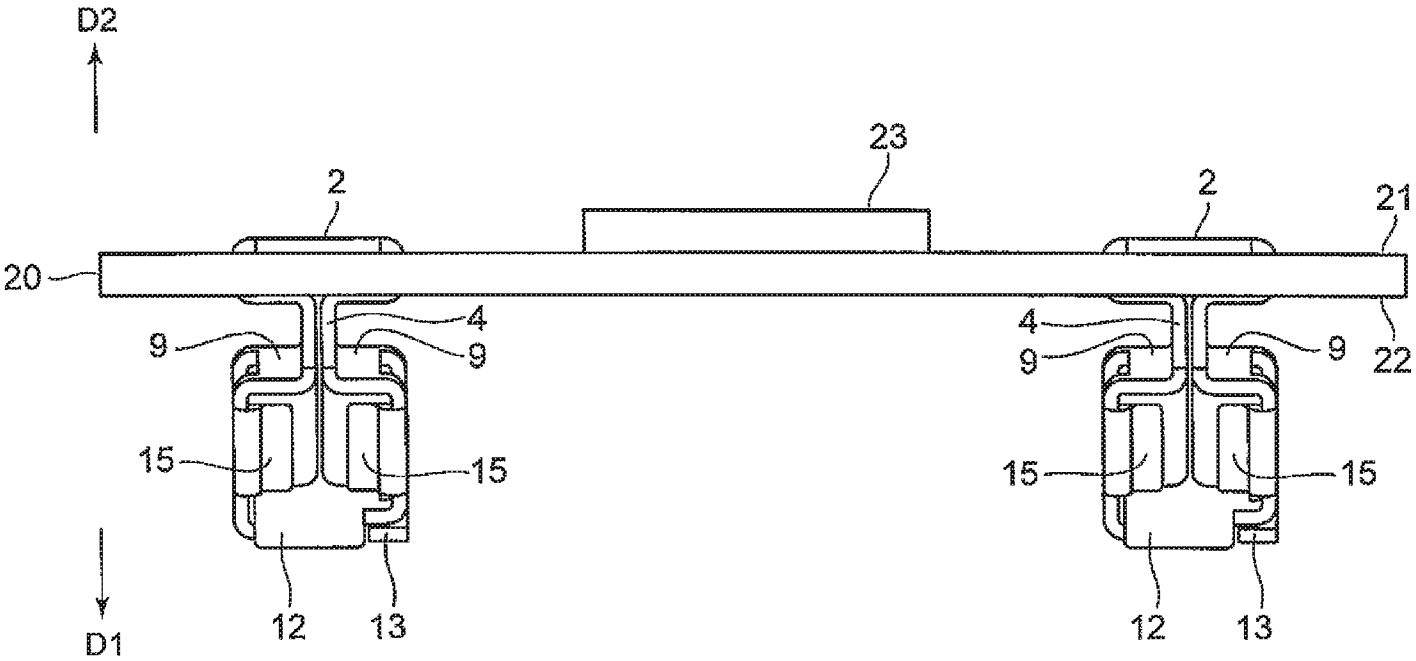
FIG. 15 is a front view showing a state where the coated conductor 16 is not inserted into the connector 1 mounted to the board 20.
Figure 16:
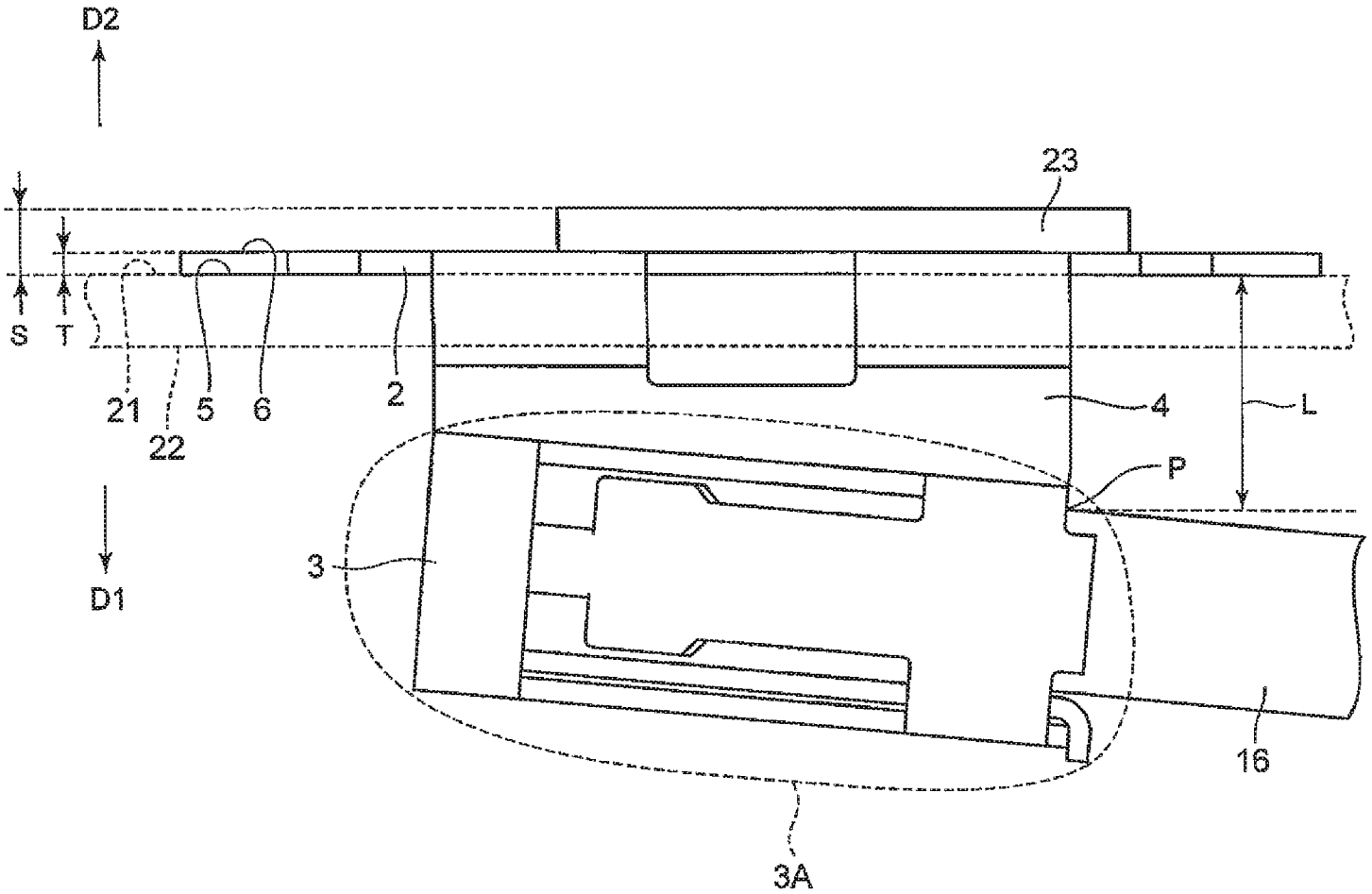
FIG. 16 is a side view for describing an effect due to a low height of a mounting portion 2.

As already described, for convenience of inserting the coated conductor 16 through the opening 10 into the receiving portion 3A, the opening 10 is exposed from the board 20 at least to the extent that the coated conductor 16 can be inserted when the connector 1 is mounted to the board 20. Referring to FIGS. 14 and 16, description will be made further in detail.

Now, it is assumed that the coated conductor 16 is inserted through the opening 10. Specifically, the coated conductor 16 is received in the receiving portion 3A at the predetermined position defined by the cable stoppers 15. Consideration will be made of the width of the opening 10. In a section of the coated conductor 16 occupying the width of the opening 10, a point at an end in the second direction D2 is depicted at P in FIG. 14. The point P is located on the coated conductor 16 in the opening 10 at an end in the second direction D2. A vertical line is drawn from the point P towards the first flat surface 5. The vertical line has a length L larger than the thickness U of the board 20.

The thickness U of the board 20 is a length between the mount surface 21 (second principal surface) of the board 20 to the rear surface 22 (first principal surface).

A part of the connector 1 located on the mount surface 21 of the board 20 is the mounting portion 2 only. The cable fitting portion 3 for receiving the coated conductor 16 is disposed on the rear surface 22 of the board 20. As the mounting portion 2 comprises the metal plate, a height T of the mounting portion 2 from the mount surface 21 corresponds to a thickness of the one metal plate. The LEDs 23 similarly mounted to the board 20 are disposed on the mount surface 21, like the mounting portion 2. A height of the LEDs 23 from the mount surface 21 is represented by S. As illustrated in FIG. 16, the height T corresponding to the one metal plate is lower than the height S of the LEDs 23. Therefore, usually, light beams emitted in parallel to the mount surface 21 are not interrupted by the mounting portion 2. From the same reason, heated air generated from the LEDs 23 is allowed to be diffused without being blocked by the mounting portion 2.

As is obvious from FIG. 3, the cable fitting portion 3 is connected to the mounting portion 2. Furthermore, the cable fitting portion 3 has the upper cover 9 having a plane which is not parallel to the plane formed by the mounting portion 2. In other words, the connector 1 has the upper cover 9 along a virtual plane located between the mounting portion 2 and the cable contact portions 11. However, the upper cover 9 is not essential to this invention. As will later be described, the mounting portion 2 may directly cover an area directly above the cable contact portions 11. In this case, the upper cover 9 is not necessary.

First Modification

Figure 17:
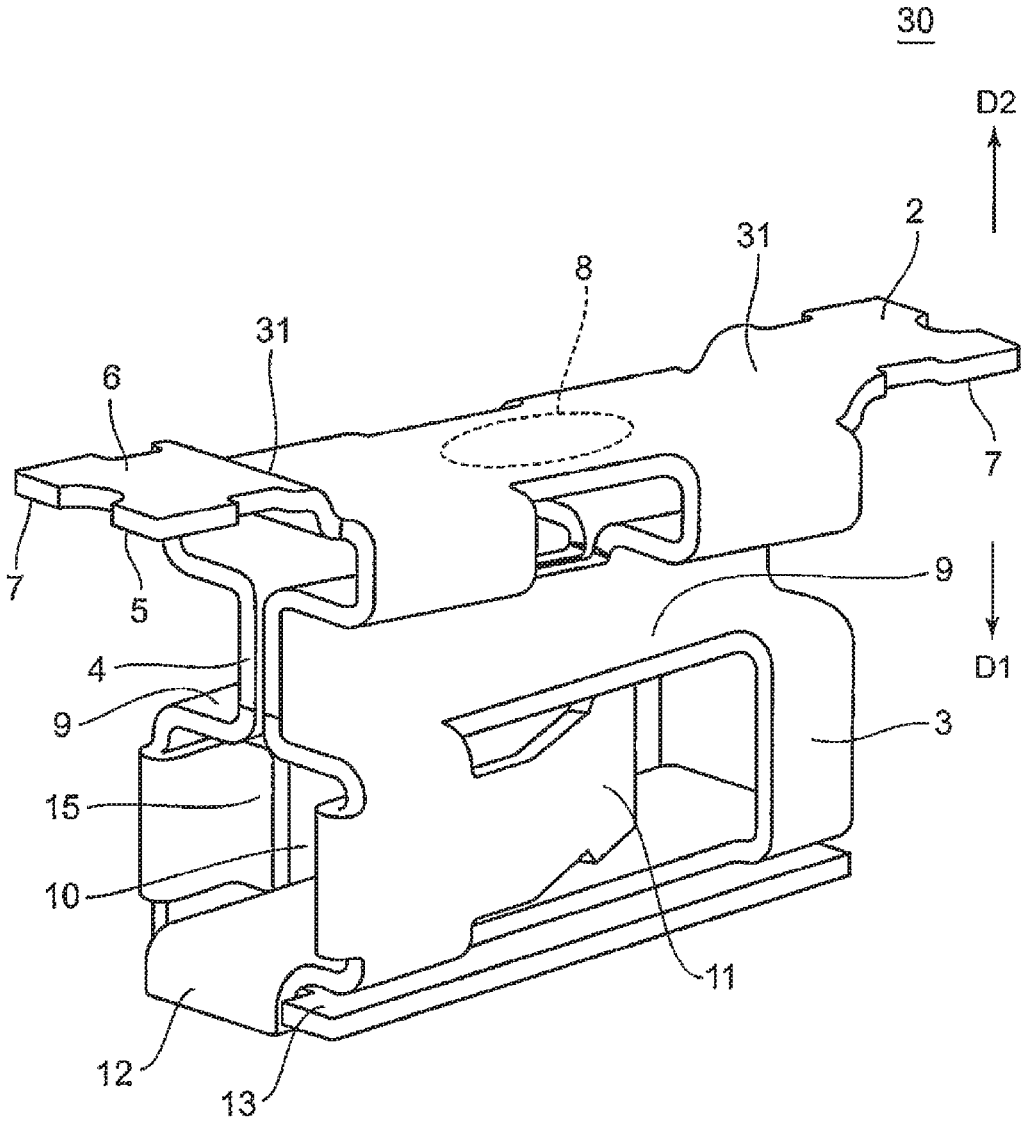
FIG. 17 is a perspective view of a connector 30 as a first modification of the connector 1.
Figure 18:
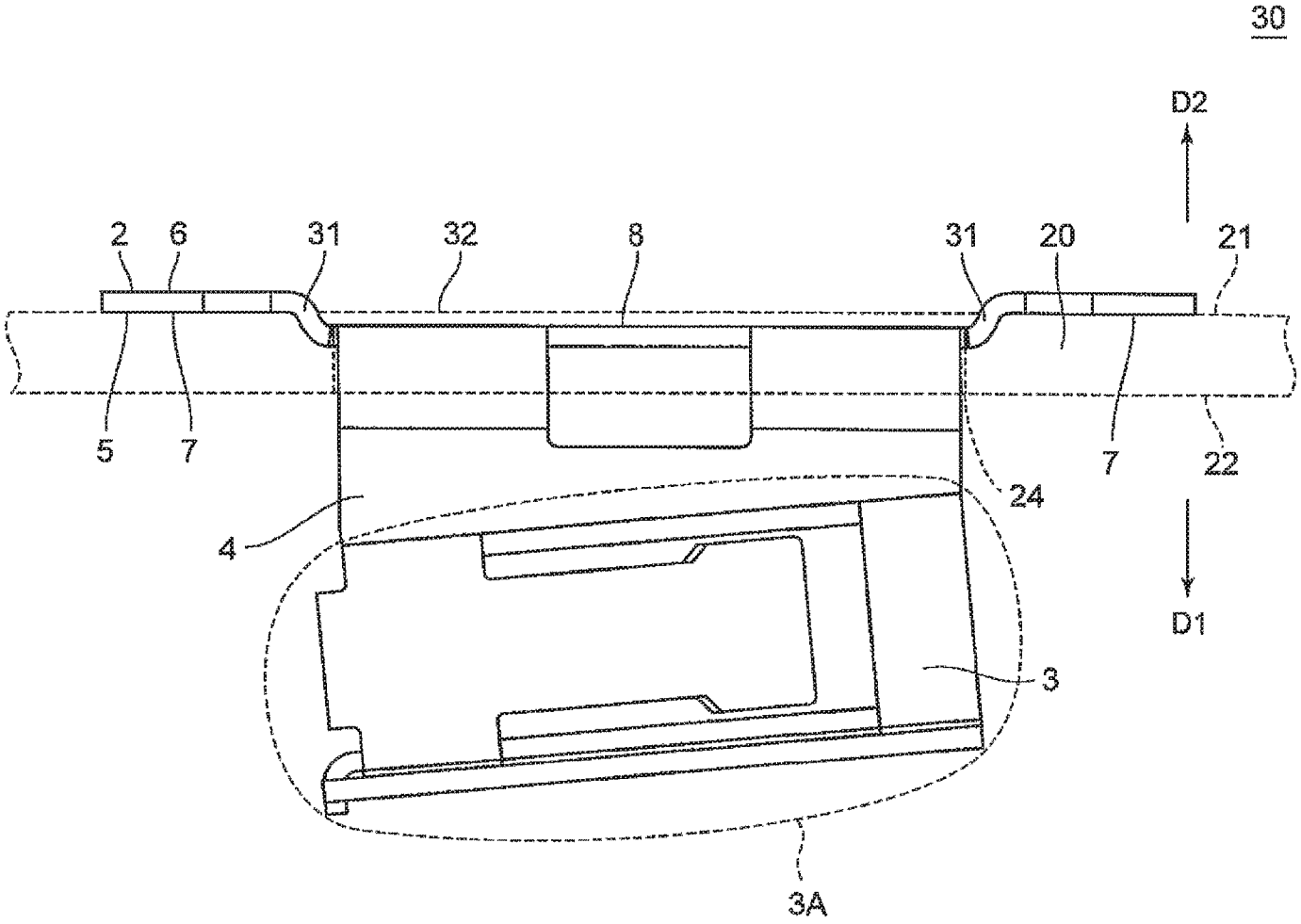
FIG. 18 is a side view of the connector 30.
Figure 19:
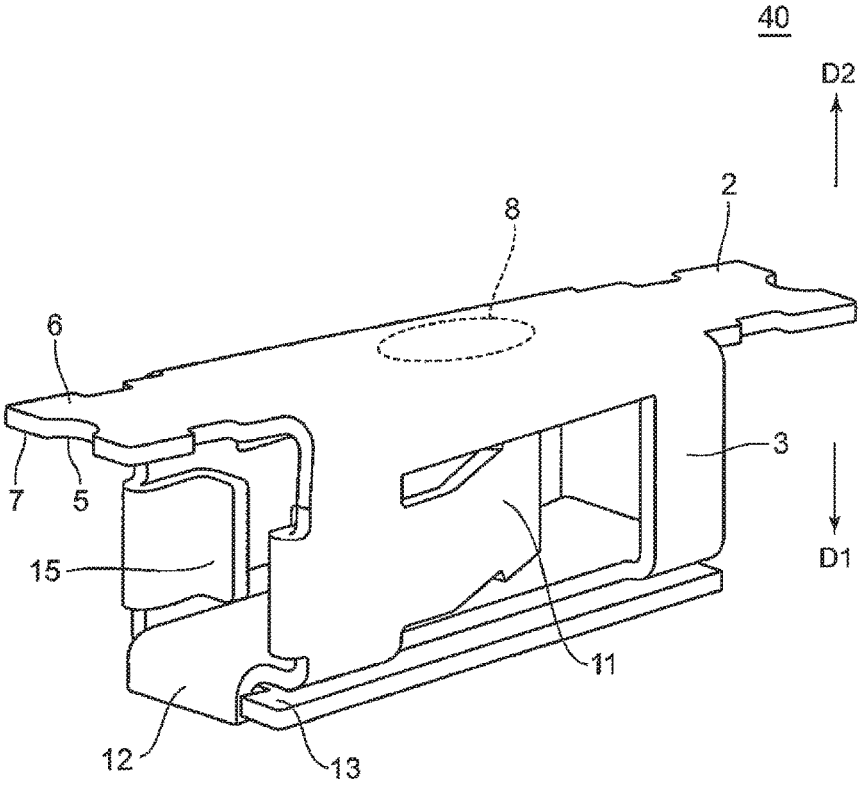
FIG. 19 is a perspective view of a connector 40 as a second modification of the connector 1.

Referring to FIGS. 17 and 18, a connector 30 as a first modification of the connector 1 will be described. The connector 30 illustrated in the figures is different from the connector 1 in that the mounting portion 2 has two bending portions 31.

Specifically, the connector 30 has the two bending portions 31 faced to each other with a center portion of the mounting portion 2, including the sucking portion 8, interposed therebetween. The center portion between the two bending portions 31 forms a recessed portion depressed towards the cable fitting portion 3. As illustrated in FIG. 18, both of the two board contact portions 7 are disposed on the mount surface 21. On the other hand, the center portion between the two bending portions 31 is configured so that the sucking portion 8 is located at a position lower than a mount surface level 32 depicted by a dotted line representing a height of the mount surface 21 and higher than the rear surface 22.

With the above-mentioned configuration, in the center portion of the mounting portion 2 between the bending portions 31, a part protruding from the mount surface 21 of the board 20 is completely excluded. Accordingly, it is possible to further reduce those objects which would shield the side surfaces of the LEDs 23 disposed on the mount surface 21.

When the suction port of the collet is brought into contact with the sucking portion 8 of the connector 30, the end of the collet is inserted inside the through hole 24 of the board 20 to be surrounded by a wall surface of the through hole 24. Therefore, the collet usable for sucking the connector 30 must have an end smaller than the through hole 24. However, during sucking, only a part of the end of the collet that corresponds to a height from the mount surface level 32 to the sucking portion 8 is required to be inserted inside the through hole 24. Therefore, if the part corresponding to the height from the mount surface level 32 to the sucking portion 8 is smaller than the through hole 24, the collet can be used to suck the connector 30. A remaining part of the collet that is located at a position higher than the mount surface level 32 may be greater than the through hole 24.

In case where the mount surface level 32 is completely coincident with the height of the sucking portion 8, the height from the mount surface level 32 to the sucking portion 8 is equal to zero and no space is present therebetween. In this case, even the collet having the end greater than the through hole 24 can be used.

Second Modification

Referring to FIGS. 19, 20, 21A and 21B, a connector 40 as a second modification of the connector 1 will be described. The connector 1 has the upper cover 9, in addition to the mounting portion 2, to cover the area above the cable contact portions 11. In association therewith, the connector 1 has the connecting portion 4 to connect the mounting portion 2 and the upper cover 9. In contrast, the connector 40 is different from the connector 1 in that the area above the cable contact portions 11 is directly covered by the mounting portion 2. Therefore, the connector 40 does not have the connecting portion 4 and the upper cover 9. The cable contact portions 11 are directly faced to the mounting portion 2.

As described above, the connector 40 is simplified in structure as compared with the connector 1 and, therefore, is easy to manufacture. As the connector 40 requires a metal plate having a smaller area, it is possible to reduce a manufacturing cost.

Figure 20:
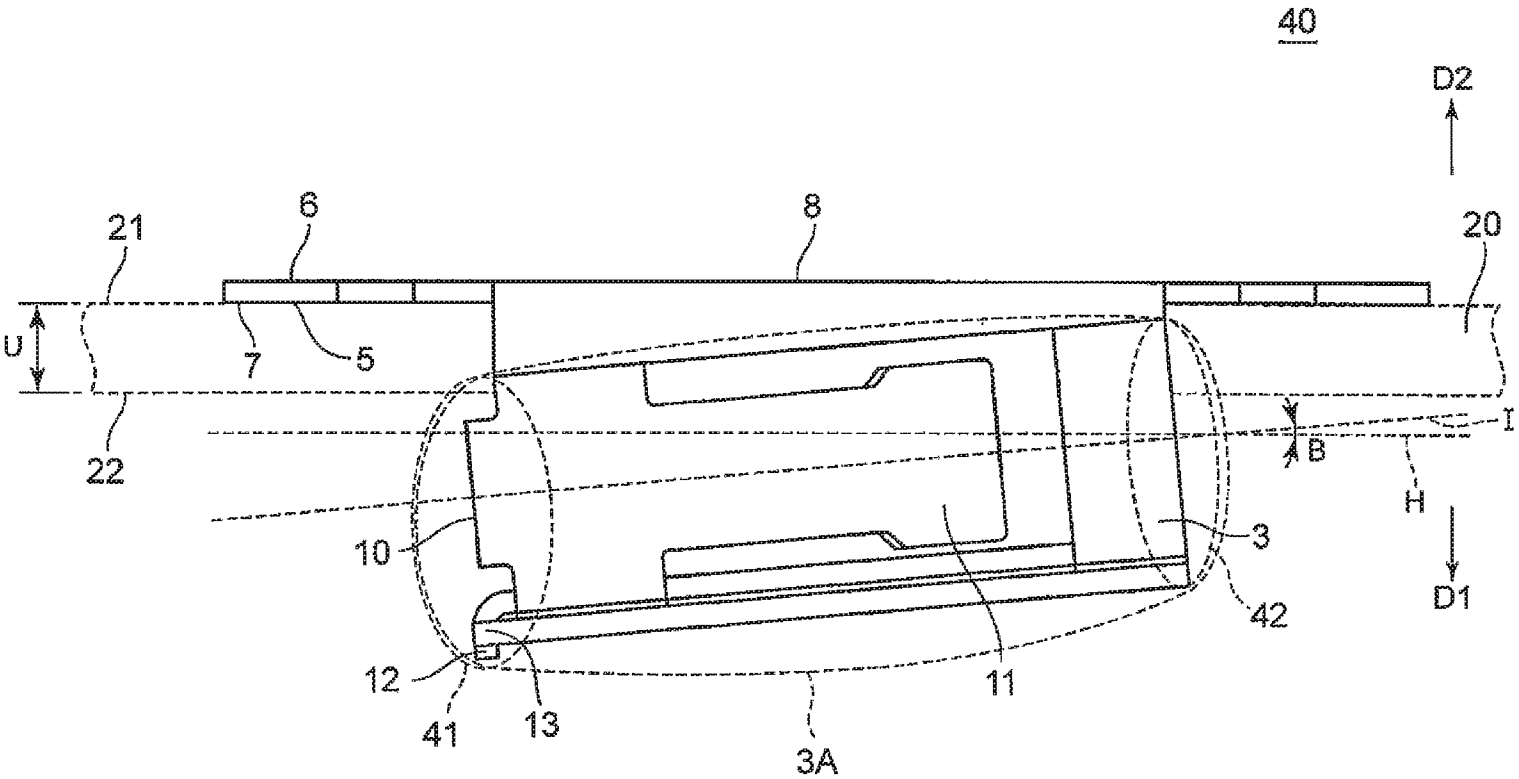
FIG. 20 is a side view of the connector 40.

As illustrated in FIG. 20, the inserting direction I of inserting the coated conductor 16 into the cable fitting portion 3 is inclined by the angle B with respect to the mount surface 21 of the board 20 and the first flat surface 5 of the mounting portion 2, like the connector 1. The coated conductor 16 inserted into the cable fitting portion 3 is held and kept in the inserting direction I.

Thus, the connector 40 does not have the connecting portion 4 and the inserting direction of inserting the coated conductor 16 into the cable fitting portion 3 is inclined with respect to the board 20. Therefore, taking the angle B, the thickness U of the board 20, and the shape and the size of the section of the coated conductor 16 into consideration, the connector 40 is appropriately configured so that, when the connector 40 is mounted to the board 20, an upper part of the receiving portion 3A is embedded inside the through hole 24 while, on the side of the receiving portion 3A having the opening 10, the opening 10 is exposed from the through hole 24 to the extent that the coated conductor 16 can be inserted. Herein, an end of the receiving portion 3A that is located on the side of the opening 10 when the receiving portion 3A is seen in the inserting direction is called an insertion start end 41 while an opposite end is called an insertion terminal end 42. When the connector 40 is mounted to the board 20, an upper part of the insertion terminal end 42 in the figure is arranged in a state where it is embedded in the through hole 24 of the board 20.

Figure 21A:
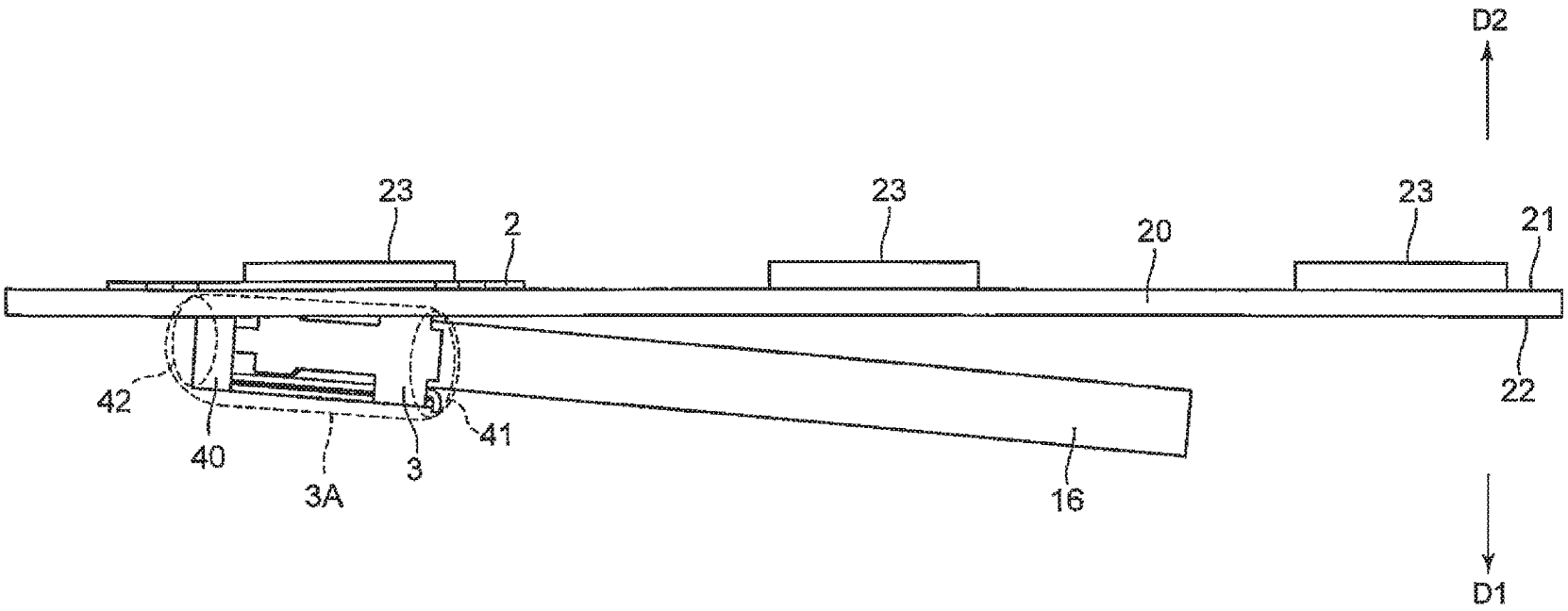
FIG. 21A is a side view of the connector 40 mounted to the board 20.
Figure 21B:
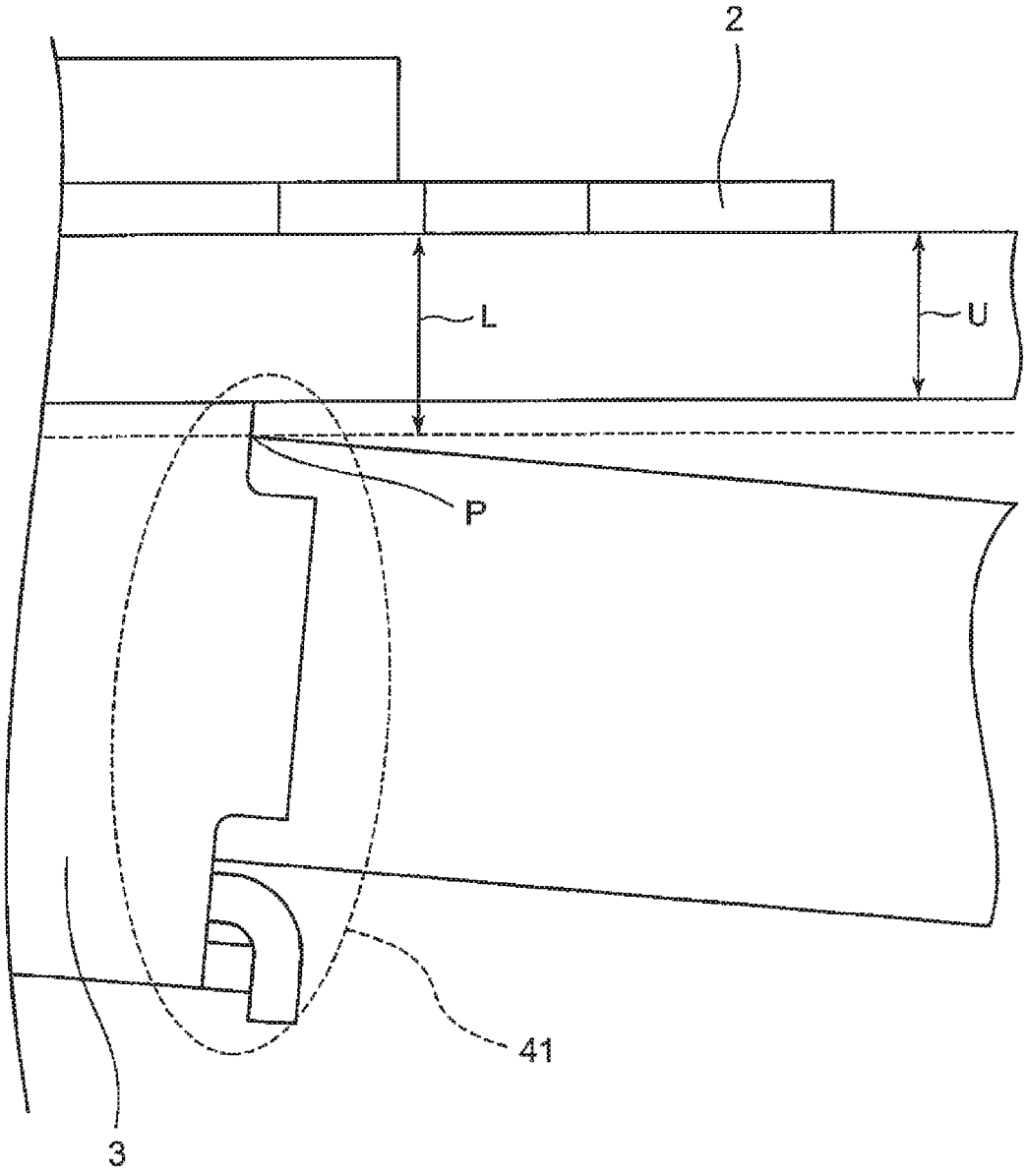
FIG. 21B is an enlarged view of a part of FIG. 21A.

A protruding amount of the receiving portion 3A from the board 20 will be described in comparison with the connector 1. Referring to FIG. 14, the connecting portion 4 of the connector 1 is located inside the through hole 24 and the receiving portion 3A entirely protrudes from the board 20. In contrast, as illustrated in FIG. 21A, the connector 40 does not have the connecting portion 4 and the upper part of the receiving portion 3A is located inside the through hole 24. In particular, the upper part of the insertion terminal end 42 is located inside the through hole 24. Therefore, in the connector 40, it is possible to lower the height of the receiving portion 3A protruding (downward) from the board 20.

Now, it is assumed that the coated conductor 16 is inserted through the opening 10. Specifically, the coated conductor 16 is received in the receiving portion 3A at the predetermined position defined by the cable stoppers 15. Consideration will be made of the width of the opening 10. In the section of the coated conductor 16 occupying the width of the opening 10, a point endmost in the second direction D2 is depicted at P in FIG. 21B. The point P is an end of the coated conductor 16 in the opening 10 in the second direction D2. A vertical line is drawn from the point P towards the first flat surface 5. The vertical line has the length L larger than the thickness U of the board 20. The thickness U of the board 20 is the length between the mount surface 21 (second principal surface) of the board 20 to the rear surface 22 (first principal surface).

Third Modification

Figure 22:
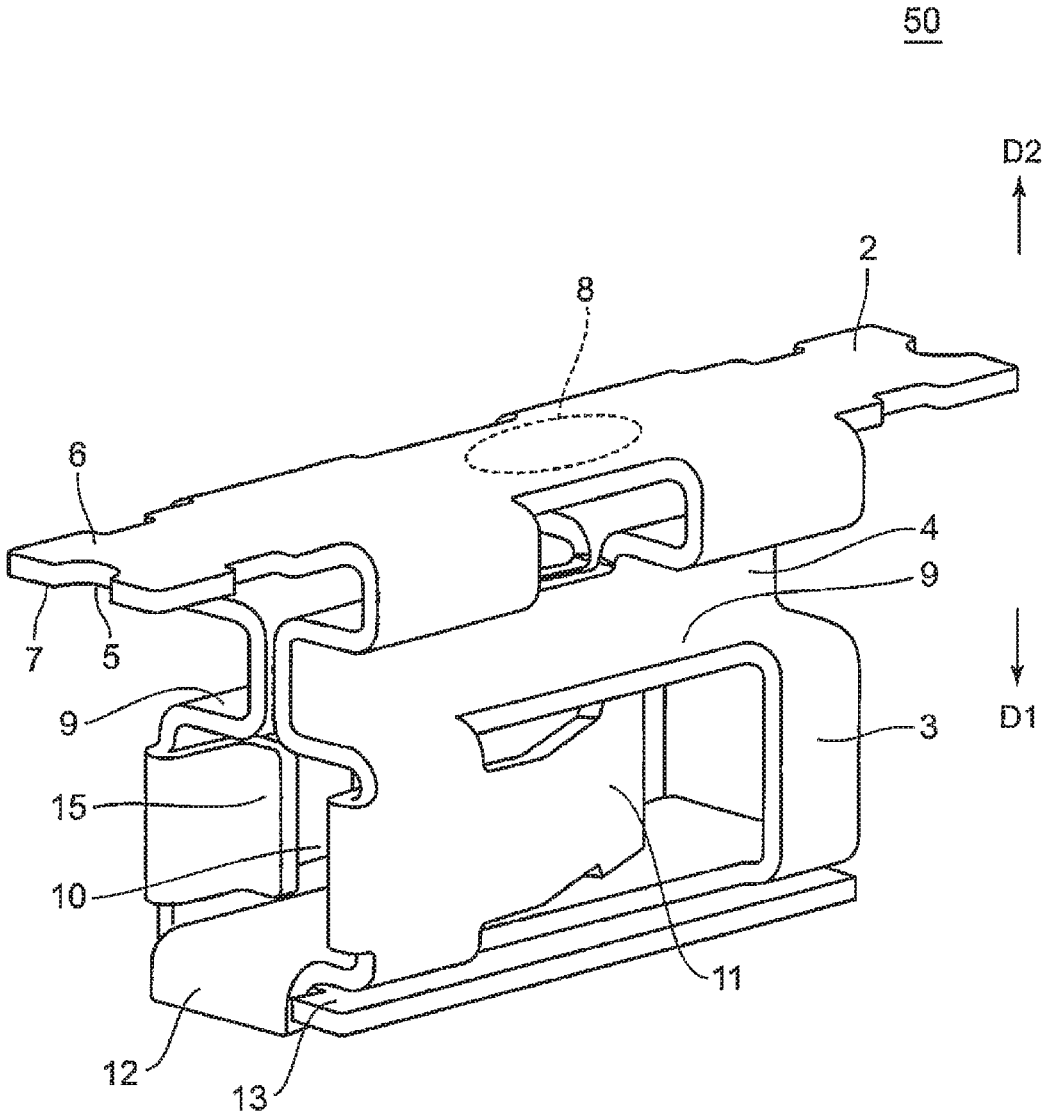
FIG. 22 is a perspective view of a connector 50 as a third modification of the connector 1.
Figure 23:
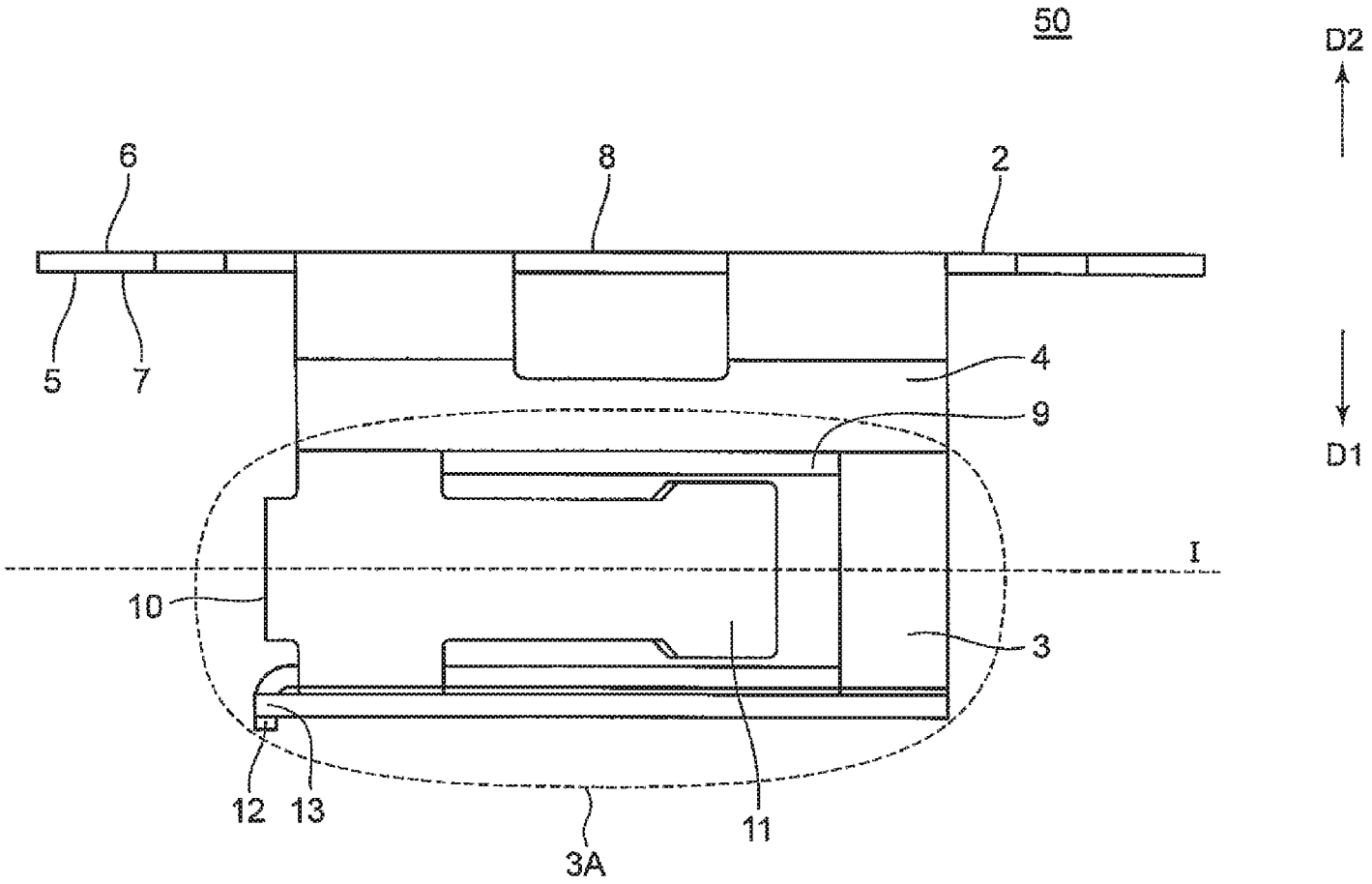
FIG. 23 is a side view of the connector 50.
Figure 24:
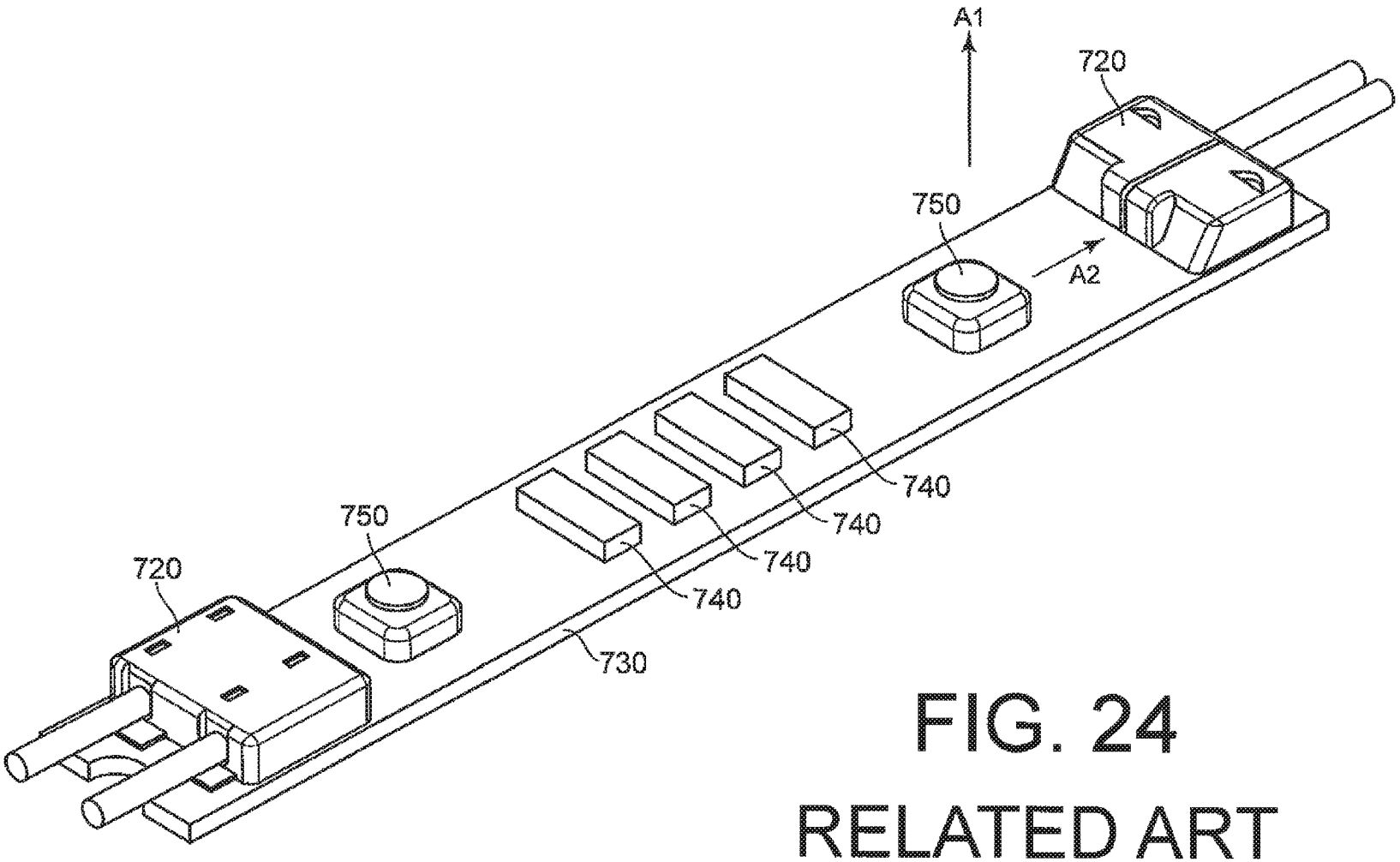
FIG. 24 RELATED ART
FIG. 24 is a perspective view for describing a connector 720 described in Patent Document 1.

Referring to FIGS. 22 and 23, description will be made of a connector 50 as a third modification of the connector 1. In the connector 1, the inserting direction I of inserting the coated conductor 16 into the receiving portion 3A is inclined by the angle B with respect to the mount surface 21 of the board 20 and the first flat surface 5 of the mounting portion 2. In contrast, in the connector 50, the inserting direction I is parallel to the mount surface 21 of the board 20 and the first flat surface 5 of the mounting portion 2. The coated conductor 16 inserted into the receiving portion 3A of the connector 50 is received and held in the inserting direction I.

In the connector 50, a bottom surface of the receiving portion 3A can be kept in parallel to the board 20. Therefore, when the board 20 with the connector 50 mounted thereto is disposed on another board, the board 20 is easily stabilized.

Although his invention has been described above in connection with the embodiment and the modifications thereof, this invention is not limited thereto.

For example, as light emitting elements to be mounted on the board to which the connector is mounted, the LEDs are described by way of example. However, the light emitting elements may be of any type. A principle of light emission of the light emitting elements is not limited at all.

Elements or devices other than the light emitting elements may be mounted to the board to which the connector of this invention is mounted. In the connector according to this invention, protrusions on the surface of the board can be reduced so that not only the light beams but also an airflow is not interrupted. Thus, it is effective to mount the connector of this invention to the board together with an element or device required to be cooled by the airflow along the board.

As illustrated in FIG. 10, in the above-mentioned embodiment, the two cantilever beams are arranged to face each other with the coated conductor 16 interposed therebetween and the ends of the cantilever beams serve as the cable contact portions 11. However, this invention is not limited the above-mentioned structure.

For example, one of the two cantilever beams may be omitted. In this case, the bare conductor 17A preferably has some hardness in order that, when the free end of the remaining cantilever beam presses the bare conductor 17A, the bare conductor 17A pushes back the free end to maintain the contact therebetween. In this case also, if the cable contact portion 11 is harder than the bare conductor 17A, it is possible to prevent the coated conductor 16 from being released, like the above-mentioned connector 1.

Alternatively, a plate-like member may be disposed at a position faced to the free end of the remaining cantilever beam in a direction perpendicular to the inserting direction I. One end face of the plate-like member is located to leave a small space from the bare conductor 17A which is inserted. Thus, at a position corresponding to the cable contact portion 11 of the cantilever beam, another plate-like member corresponding to the plate-like members of the cable stoppers 15 is arranged. In this case, the free end of the cantilever beam serves to press the bare conductor 17A against the one end face of the plate-like member.

In the above-mentioned embodiment and the modifications, the cable stoppers 15 illustrated in the figures are described by way of example. However, cable stoppers of a type different from the cable stoppers 15 may be used.

Generally speaking, the cable stoppers comprise plate-like members as follows. Let the state where the coated conductor 16 is received in the receiving portion 3A be seen through in the inserting direction I. At this time, the plate-like members serving as the cable stoppers are arranged so as to overlap the cover 18 and not to overlap the conductor 17. As the cable stoppers satisfying the above-mentioned condition, various types of cable stoppers can be proposed other than the above-mentioned cable stoppers 15.

For example, the plate-like members may protrude in different directions. The cable stoppers 15 comprise the two plate-like members protruding from the inner walls, left and right in the figure, behind the opening 10 in the direction perpendicular to the inserting direction I of inserting the coated conductor 16. Instead, the two plate-like members may protrude from upper and lower inner walls in the figure, respectively.

Furthermore, the number of the plate-like members may be different. The cable stoppers 15 comprise the two plate-like members but the number of the plate-like members is not limited to two. The cable stopper or stoppers may comprise a single plate-like member or three or more plate-like members.

Furthermore, the gap between the cable stoppers may have a different shape. Between the ends of the two plate-like members forming the cable stoppers 15, a rectangular gap is formed. Instead, the gap may have a shape other than the rectangular shape. For example, the gap may form a circular hole or an elliptical hole.

As regards the cable to be interfered by the cable stoppers, variations may be proposed other than the above-mentioned embodiment and the modifications. In the embodiment and the modifications, the cable is the coated conductor. The coated conductor 16 basically has a circular section and the conductor 17 also has a circular section. However, the cable is not limited to the coated conductor described above. The cable for use with the connector of this invention may not be the coated conductor. In this case, it is not necessary to provide the connector with the cable stoppers. Furthermore, the sectional shape may not be circular. For example, the coated conductor or the conductor may have an elliptical or a rectangular section.

The ends of the cable contact portions 11 bite into the bare conductor 17A to prevent the coated conductor 16 from being released. In order to facilitate biting, the ends of the cable contact portions 11 may be sharpened.

What is claimed is:

1. A connector comprising a mounting portion of a plate-like shape and a cable fitting portion protruding from the mounting portion in a first direction;

the mounting portion having:

a first flat surface faced to the first direction;

a second flat surface faced to a second direction opposite to the first direction;

a fixing portion adapted to be fixed to a board and disposed on the first flat surface; and a flat portion disposed on the second flat surface;

the cable fitting portion having:

a receiving portion adapted to receive a cable;

an opening portion formed at one end of the receiving portion and allowing the cable to pass therethrough; and a cable contact portion to be electrically connected to the cable;

wherein:

the cable is formed by bending one metal plate;

one end and the other end of the metal plate are bent to overlap each other;

the one end being provided with a projecting portion; and the other end having a bending portion bent to be engaged with the projecting portion.

2. The connector according to claim 1, wherein the mounting portion has a flat shape.

3. The connector according to claim 1, wherein:

the mounting portion has a recessed portion depressed in the first direction;

the flat portion being provided in the recessed portion.

4. The connector according to claim 3, wherein:

when the fixing portion is fixed to the board, the flat portion is located between a first principal surface of the board faced to the first direction and a second principal surface of the board faced to the second direction.

5. The connector according to claim 1, wherein:

the receiving portion is inclined with respect to the first flat surface so that a distance from the first flat surface is gradually reduced from one end of the receiving portion that is provided with the opening portion towards the other end of the receiving portion which is opposite to the one end.

6. The connector according to claim 1, wherein:

when the fixing portion is fixed to the board, at least a part of the other end of the receiving portion opposite to the one end provided with the opening portion is located between a first principal surface of the board that is faced to the first direction and a second principal surface of the board that is faced to the second direction.

7. The connector according to claim 1, wherein:

the receiving portion having a plate-like member disposed in a direction intersecting with an inserting direction of inserting a cable into the receiving portion, the cable having a conductor and a covering portion covering the conductor;

the plate-like member overlapping the covering portion and not overlapping the conductor when a state where the cable is received in the receiving portion is seen through in the inserting direction.

8. The connector according to claim 1, wherein:

the cable contact portion comprises a flat plate made of a material harder than a conductor of the cable received in the receiving portion;

the flat plate comprises a first end and a second end;

the first end is disposed toward a front portion of the flat plate and the second end is disposed toward a back portion of the flat plate when viewed in a direction of inserting the cable through the opening portion into the receiving portion;

the first end is fixed to the receiving portion;

the flat plate extending from the receiving portion in the direction of inserting the cable and thereafter bending in a direction obliquely intersecting with the direction of inserting the cable to form a bend;

the flat plate extending straight from the bend;

the second end of the flat plate contacts a conductor of the cable when the cable is received in the receiving portion.

9. The connector according to claim 1, wherein:

the cable contact portion comprises a pair of flat plates made of a material harder than a conductor of the cable received in the receiving portion;

each flat plate of the pair of flat plates comprises a respective first end and a respective second end;

each respective first end is disposed toward a front portion of the respective flat plate and each respective second end is disposed toward a back portion of the respective flat plate when the cable is seen in a direction of inserting the cable through the opening portion into the receiving portion, each first end is fixed to the receiving portion;

the flat plates extending from the receiving portion in the direction of inserting the cable and thereafter bending in directions obliquely intersecting with the direction of inserting the cable to form bends;

the flat plates extending straight from the bends;

each second end of the flat plates clamps a conductor of the cable when the cable is received in the receiving portion.

10. The connector according to claim 1, wherein:

the cable fitting portion further has a connecting portion connecting the mounting portion and the receiving portion.

11. The connector according to claim 1, wherein a length of a vertical line drawn from a point P of the cable inserted in the opening portion to the first flat surface or an extension thereof is longer than a distance from a first principal surface to a second principal surface, where the point P is located on the cable in the opening portion at an end in the second direction.

12. An illuminating device comprising aboard having a first principal surface, a second principal surface, and a through hole; a light emitting portion disposed on the second principal surface, and a connector;

the connector comprising a mounting portion of a plate-like shape and a cable fitting portion protruding from the mounting portion in a first direction;

the mounting portion having:

a first flat surface faced to the first direction;

a second flat surface faced to a second direction opposite to the first direction;

a fixing portion adapted to be fixed to a board and disposed on the first flat surface; and a flat portion disposed on the second flat surface;

the cable fitting portion having:

a receiving portion adapted to receive a cable;

an opening portion formed at one end of the receiving portion and allowing the cable to be inserted therethrough; and a cable contact portion to be electrically connected to the cable;

the cable fitting portion protruding from the second principal surface through the through hole onto the first principal surface, the fixing portion being fixed to the second principal surface.

13. The illuminating device according to claim 12, wherein a height of the mounting portion protruding from the second principal surface is lower than a height of the light emitting portion protruding from the second principal surface.

14. The illuminating device according to claim 12, wherein a length of a vertical line drawn from a point P of the cable inserted in the opening portion to the first flat surface or an extension thereof is longer than a distance from the first principal surface to the second principal surface, where the point P is located on the cable in the opening portion at an end in the second direction.

* * * * *